US008770702B2

(12) United States Patent
Sugahara et al.

(10) Patent No.: US 8,770,702 B2
(45) Date of Patent: Jul. 8, 2014

(54) LIQUID DROPLET JETTING APPARATUS AND LIQUID DROPLET JETTING STATE INSPECTION UNIT

(75) Inventors: Hiroto Sugahara, Ama (JP); Hirofumi Kondo, Tajimi (JP); Shohei Koide, Nagoya (JP); Hiromitsu Mizutani, Ichinomiya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 356 days.

(21) Appl. No.: 13/354,651

(22) Filed: Jan. 20, 2012

(65) Prior Publication Data

US 2012/0229552 A1 Sep. 13, 2012

(30) Foreign Application Priority Data

Mar. 11, 2011 (JP) ..... 2011-054209

(51) Int. Cl.
*B41J 29/393* (2006.01)
*B41J 2/125* (2006.01)

(52) U.S. Cl.
CPC ..... *B41J 2/125* (2013.01)
USPC ..... 347/19

(58) Field of Classification Search
None
See application file for complete search history.

(56) References Cited

U.S. PATENT DOCUMENTS

| | | | | |
|---|---|---|---|---|
| 7,497,547 | B2 | 3/2009 | Komatsu | |
| 2006/0157579 | A1 | 7/2006 | Komatsu | |
| 2010/0079535 | A1* | 4/2010 | Sayama et al. | 347/19 |
| 2010/0149235 | A1* | 6/2010 | Komatsu et al. | 347/9 |

FOREIGN PATENT DOCUMENTS

| | | |
|---|---|---|
| JP | 2000-085149 | 3/2000 |
| JP | 2005/246695 | 9/2005 |
| JP | 2006-175849 | 7/2006 |
| JP | 2006-272634 | 10/2006 |
| JP | 2010-076361 | 4/2010 |

OTHER PUBLICATIONS

Decision to Grant a Patent for Japanese Application No. 2011-054209 dated Feb. 5, 2013.

* cited by examiner

*Primary Examiner* — Geoffrey Mruk
*Assistant Examiner* — Bradley Thies
(74) *Attorney, Agent, or Firm* — Frommer Lawrence & Haug LLP

(57) ABSTRACT

A liquid droplet jetting apparatus includes: a liquid droplet jetting head which has a liquid droplet jetting surface on which a plurality of nozzles are open and aligned in a row in a first direction; and a liquid droplet jetting state inspection unit which inspects liquid droplet jetting state of each of the nozzles, including: a liquid droplet landing body which has a landing surface facing the liquid droplet jetting surface and on which the liquid droplets jetted from each of the nozzles land, and which is configured to be relatively movable, with respect to the liquid droplet jetting head, in a second direction which is parallel to the liquid droplet jetting surface and intersects the first direction; and a landing detection mechanism which detects whether or not the liquid droplets have landed on a predetermined detection area provided on the landing surface of the liquid droplet landing body.

23 Claims, 19 Drawing Sheets

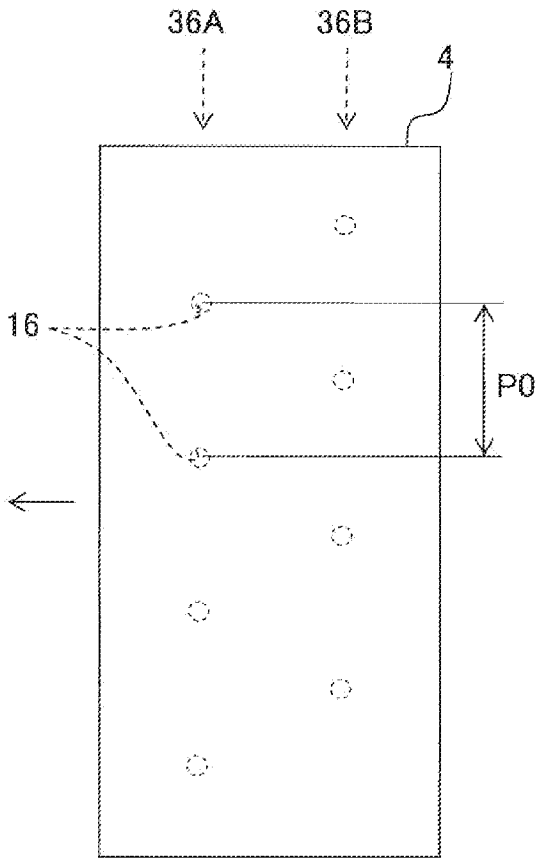
Fig. 9
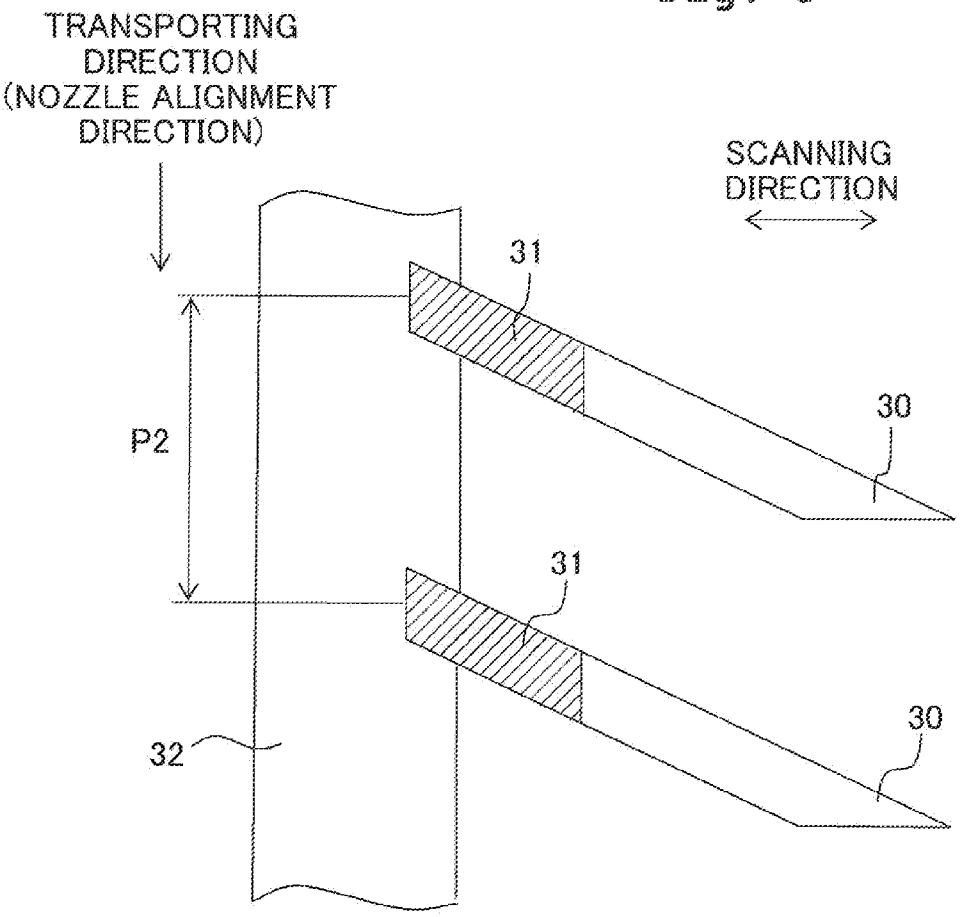

LIQUID DROPLET JETTING APPARATUS AND LIQUID DROPLET JETTING STATE INSPECTION UNIT

CROSS REFERENCE TO RELATED APPLICATION

The present application claims priority from Japanese Patent Application No. 2011-054209, filed on Mar. 11, 2011, the disclosure of which is incorporated herein by reference in its entirety.

BACKGROUND OF THE INVENTION

1. Field of the Invention

The present invention relates to a liquid droplet jetting apparatus which includes a liquid droplet jetting head, and a liquid droplet jetting state inspection unit which inspects liquid droplet jetting state of the liquid droplet jetting head.

2. Description of the Related Art

An apparatus which includes a unit for inspecting liquid droplet jetting state of a nozzle has hitherto been known as a liquid droplet jetting apparatus which includes a liquid droplet jetting head having a plurality of nozzles.

For instance, a unit which inspects liquid droplet jetting state of an ink jet head of an ink jet recording apparatus has been disclosed in US Patent Application Publication No. 2010/0079535 (corresponds to Japanese Patent Application Laid-open No. 2010-76361). The inspection unit in the US Patent Application Publication No. 2010/0079535 has a vibration plate facing nozzle openings of the ink-jet head, and a piezoelectric element which is joined to the vibration plate, and vibration (deformation) of the vibration plate, which is generated when droplets of ink are landed, is converted to a voltage signal by the piezoelectric element. Consequently, it is possible to inspect whether or not there is misjetting in the nozzle, based on an output voltage of the piezoelectric element.

As a jetting defect of a nozzle, in addition to a defect in which liquid droplets are not at all jetted (misjetting), there is also a detect in which the liquid droplets are jetted from the nozzle but the jetting direction of the nozzle is inclined with respect to a regular (normal) direction (also called as inclined jetting). When the jetting is inclined, landing position of droplets is deviated from the original position. Therefore, it is preferable that the inclined jetting is also detected similarly as misjetting.

However, in the inspection apparatus in US Patent Application Publication No. 2010/0079535, although it is possible to detect whether or not the ink droplets are landed on the vibration plate from a change in the output voltage of the piezoelectric element, it is not possible to detect accurately as to at which position of the vibration plate the liquid droplets have landed. Accordingly, it is not possible to detect inclined jetting by comparing the actual landing position with the original landing position when there is no inclined jetting.

SUMMARY OF THE INVENTION

An object of the present teaching is to provide a liquid droplet jetting apparatus and a liquid droplet jetting state inspection unit, in which it is possible to detect an inclination of a jetting direction of liquid droplets (inclined jetting) of each nozzle.

According to a first aspect of the present invention, there is provided a liquid droplet jetting apparatus which jets liquid droplets, including: a liquid droplet jetting head which has a liquid droplet jetting surface on which a plurality of nozzles are open and aligned in a row in a first direction; and a liquid droplet jetting state inspection unit which inspects liquid droplet jetting state of each of the nozzles, including: a liquid droplet landing body which has a landing surface facing the liquid droplet jetting surface and on which the liquid droplets jetted from each of the nozzles land, and which is configured to be relatively movable, with respect to the liquid droplet jetting head, in a second direction which is parallel to the liquid droplet jetting surface and intersects the first direction; and a landing detection mechanism which detects whether or not the liquid droplets have landed on a predetermined detection area provided on the landing surface of the liquid droplet landing body, wherein the detection area of the landing surface has a first edge which extends in a direction inclined toward the second direction with respect to a third direction which is orthogonal to the second direction.

In the present invention, the first edge of the detection area provided on the landing surface of the liquid droplet landing body extends in a direction inclined with respect to the third direction orthogonal to the relative movement direction of the liquid droplet jetting head (second direction). Therefore, when the jetting direction of one of the nozzles is inclined in the second direction which is the relative movement direction of the liquid droplet jetting head with respect to the liquid droplet landing body, as well as when the jetting direction of the one of the nozzles is inclined in the third direction which is orthogonal to the second direction, a timing at which one of the liquid droplets lands on the first edge is different as compared to a case in which there is no inclined jetting (when the jetting direction of the one of the nozzles is a predetermined (regular) direction). Consequently, from the difference in timing of landing on the first edge, it is possible to detect a state in which the jetting direction of jetting of each of the nozzles is inclined (inclined jetting).

In the inclined jetting in the second direction and the inclined jetting in the third direction, generally, an effect of the inclined jetting in the third direction orthogonal to the relative movement direction of the liquid droplet jetting head is more adverse. When the liquid droplet jetting head forms a dot row in the third direction and the second direction respectively on an object by moving relatively in the second direction while jetting liquid droplets on the object from the plurality of nozzles forming one nozzle row, the dot row in the third direction on the object is formed by the liquid droplets being jetted simultaneously from the plurality of nozzles aligned in the first direction, whereas, the dot row in the second direction is formed by jetting the liquid droplets continuously from one of the nozzles. Consequently, when the jetting is inclined in the third direction for a certain nozzle, for the dot row in the third direction, an interval between dots (a distance between dots) which are formed by a liquid droplet from the certain nozzle and another liquid droplet from a normal nozzle adjacent to the certain nozzle, is substantially wider in the third direction, whereas, when the jetting is inclined in the second direction, a position of the overall dot row in the second direction is shifted a bit and there is no change in the interval of dots (distance between dots). Consequently, in the present teachings, the fact that it is possible to detect the inclined jetting in the third direction in particular is substantially significant.

According to a second aspect of the present invention, there is provided a liquid droplet jetting state inspection unit which inspects liquid droplet jetting state of each of a plurality of nozzles of a liquid droplet jetting head having a liquid droplet jetting surface on which the nozzles are open and aligned in a row in a first direction, the unit including: a liquid droplet landing body which has a landing surface facing the liquid droplet jetting surface and on which liquid droplets jetted from each of the nozzles land, and which is configured to be relatively movable, with respect to the liquid droplet jetting head, in a second direction which is parallel to the liquid droplet jetting surface and intersects the first direction; and a landing detection mechanism which detects whether or not the liquid droplets have landed on a predetermined detection area provided on the landing surface of the liquid droplet landing body, wherein the detection area of the landing surface has a first edge which extends in a direction inclined toward the second direction with respect to a third direction which is orthogonal to the second direction.

BRIEF DESCRIPTION OF THE DRAWINGS

FIG. 9 is a plan view of a jetting state inspection unit according to a fourth modified embodiment of the present teaching.

DETAILED DESCRIPTION OF THE PREFERRED EMBODIMENTS

Exemplary embodiment and modified embodiments of the present teaching will be described below.

Figure 1:
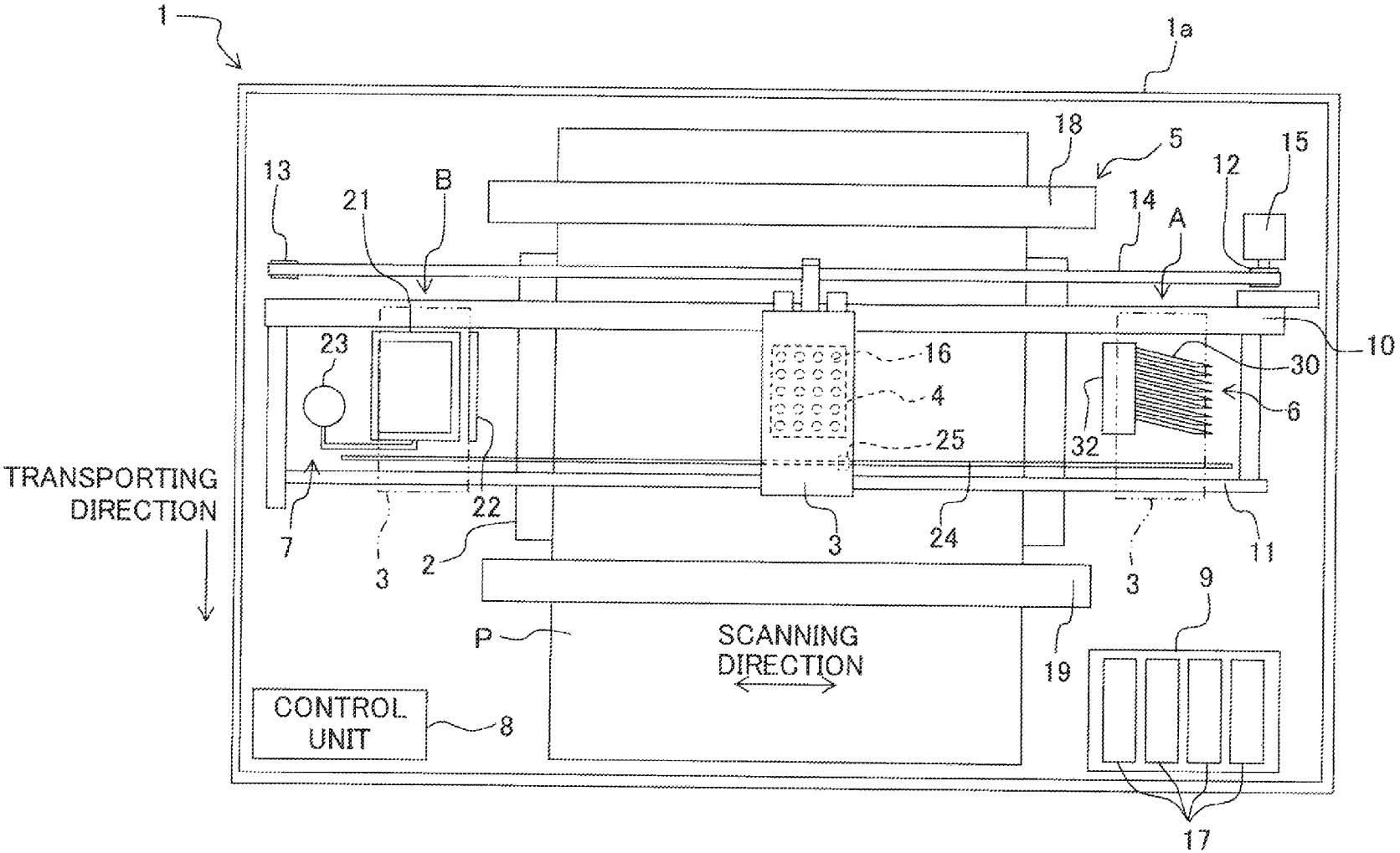
FIG. 1 is a schematic structural view of an ink-jet printer according to an embodiment of the present teaching.

As shown in FIG. 1, an ink-jet printer 1 (liquid droplet jetting apparatus) includes a platen 2 on which a recording paper P is to be placed, a carriage 3 which is capable of reciprocating in a scanning direction parallel to the platen 2, an ink jet head 4 (liquid droplet jetting head) which is mounted on the carriage 3, a transport mechanism 5 which transports the recording paper P in a transporting direction which is orthogonal to the scanning direction, a jetting state inspection unit 6 (liquid droplet jetting state inspection unit) which inspects jetting state of liquid droplets from nozzles 16 of the ink-jet head 4, a maintenance unit 7 which carries out various maintenance jobs related to recovery and maintenance of a liquid droplet jetting performance of the ink-jet head 4, a control unit 8 which carries out an overall control of the ink-jet printer 1, and the like.

The recording paper P which has been supplied from a paper feeding mechanism (not shown in the diagram) is placed on an upper surface of the platen 2. Moreover, two guide rails 10 and 11 extending parallel in a left-right direction (scanning direction) in FIG. 1 are provided at an upper side of the platen 2, and the carriage 3 is capable of reciprocating in the scanning direction along the guide rails 10 and 11 in an area facing the platen 2. Moreover, the two guide rails 10 and 11 extend from the plate 2 up to positions away toward left and right in FIG. 1 along the scanning direction, and the carriage 3 is capable of moving from an area (recording area) facing the recording paper P on the platen 2 up to the positions away in the left-right direction from the platen 2, which are no-recording areas. Moreover, an endless belt 14 which is put around two pulleys 12 and 13 is coupled with the carriage 3, and when the endless belt 14 is driven by a carriage driving motor 15, the carriage 3 moves in the scanning direction with the running of the endless belt 14.

A linear encoder 24 having a multiple number of light transmission portions (slits) which are arranged in rows at an interval in the scanning direction is provided to a printer main body 1*a* of the ink-jet printer 1. Whereas, a photosensor 25 (position detection mechanism) of a transmission type having a light emitting element and a light receiving element is provided to the carriage 3. The ink-jet printer 1 is capable of identifying the current position of the carriage 3 in the scanning direction from a discrete value (the number of detection)

of the light transmission portion of the linear encoder 24, which is detected by the photosensor 25 during the movement of the carriage 3.

Figure 3:
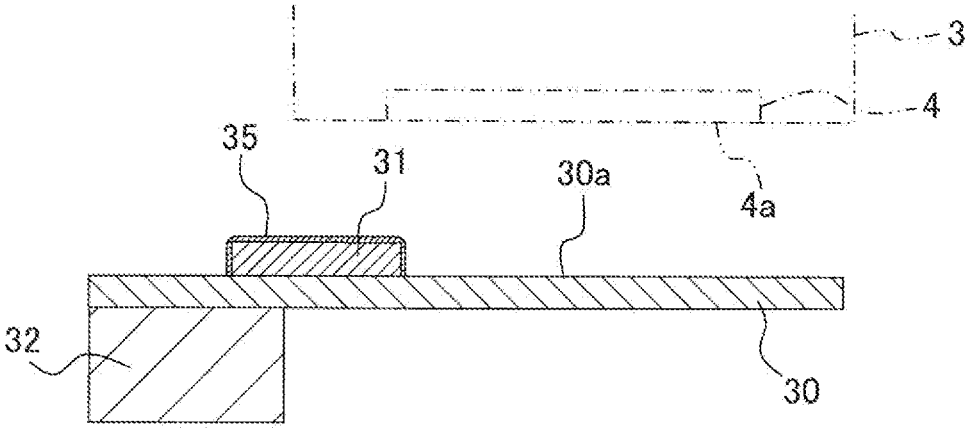
FIG. 3 is a cross-sectional view taken along a line in FIG. 2.

The ink-jet head 4 is installed at a lower portion of the carriage 3, and a lower surface (surface on the other side of a paper surface in FIG. 1) of the ink-jet head 4, which is parallel to the upper surface of the platen 2 is a liquid droplet jetting surface 4*a* in which the plurality of nozzles 16 are open (refer to FIG. 3 which will be described later). Moreover, as shown in FIG. 1, a stationary holder 9 is provided to the printer main body 1*a* of the ink jet printer 1, and four ink cartridges 17 in which inks of four colors (black, yellow, cyan, and magenta) are stored respectively are installed on the holder 9. Moreover, the ink-jet head 4 mounted on the carriage 3 and the holder 9 are connected by four tubes (not shown in the diagram), and inks inside the four ink cartridges 17 are supplied to the ink jet head 4 via the four tubes.

The plurality of nozzles 16 of the ink jet head 4 is aligned in a row in the transporting direction, and furthermore, forms a plurality of nozzle rows (an example of four nozzle rows is shown in FIG. 1). A direction in which the nozzles 16 are aligned in a row (first direction) may be inclined toward the scanning direction with respect to the transporting direction (third direction) which is orthogonal to the scanning direction (second direction). Namely, the alignment direction of the nozzles 16 intersects with the scanning direction. Moreover, the ink-jet head 4 includes an actuator (not shown in the diagram) which applies a pressure on the inks inside the plurality of nozzles 16, and makes jet droplets of ink separately from each of the plurality of nozzles 16. A structure of the actuator is not restricted to any particular structure, and a heretofore known actuator such as a piezoelectric actuator in which a piezoelectric distortion of a piezoelectric element is used can be utilized. The ink-jet head 4 jets inks of the colors from the plurality of nozzles 16 respectively onto the recording paper P which has been placed on the platen 2, by the actuator.

The transport mechanism 5 has two transporting rollers 18 and 19 which are arranged to sandwich the platen 2 in the transporting direction, and transports the recording paper P placed on the platen 2 in the transporting direction.

Moreover, the ink jet printer 1 jets an ink onto the recording paper P placed on the platen 2 from the ink-jet head 4 which reciprocates in the scanning direction (left-right direction in FIG. 1) together with the carriage 3, and prints a desired image or characters on the recording paper P by transporting the recording paper P in the transporting direction by the two transporting rollers 18 and 19.

The jetting state inspection unit 6 is arranged at a position away at one side of the scanning direction (right side in FIG. 1) with respect to the platen 2 (inspection position: position A where the carriage 3 is indicated by an alternate long and two short dashes line in FIG. 1). The jetting state inspection unit 6 is a unit which inspects a jetting defect such as misjetting or inclined jetting, for each of the plurality of nozzles 16 of the ink-jet head 4. A concrete structure of the jetting state inspection unit 6 will be described later in detail.

The maintenance unit 7 is arranged at a position on an opposite side (left side in the diagram) of the inspection position A at which the jetting state inspection unit 6 is arranged (maintenance position: position B where the carriage 3 is indicated by alternate long and two short dashes line in FIG. 1), thereby sandwiching the platen 2 between the maintenance unit 7 and the jetting state inspection unit 6. The maintenance unit 7 includes a cap member 21 which covers the openings of the plurality of nozzles 16 by making a close contact with a lower surface (liquid droplet jetting surface 4*a*) of the ink-jet head 4, a suction pump 23 which is connected to the cap member 21, and a wiper 22 which wipes ink adhered to the liquid droplet jetting surface 4*a* after suction purge.

Figure 5:
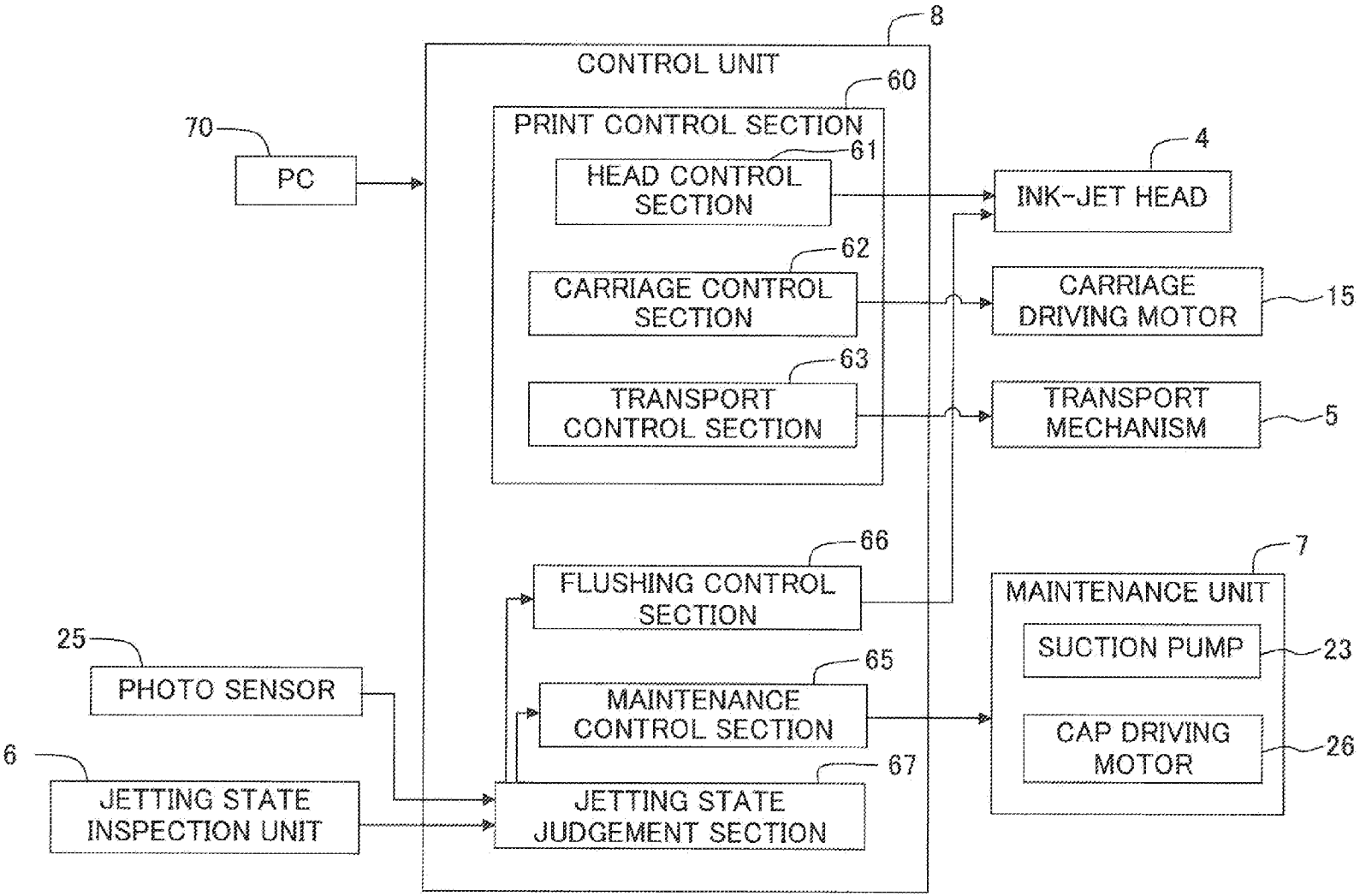
FIG. 5 is a block diagram showing a control system of a printer.

The cap member 21 is movable in a vertical direction (direction perpendicular to the paper surface of FIG. 1) and is driven to approach and be separated away from the liquid droplet jetting surface 4*a* of the ink-jet head 4 by a suitable cap driving mechanism which includes a cap driving motor 26 (refer to FIG. 5). Moreover, in a state that the cap member 21 has made a close contact (capping) with the liquid droplet jetting surface 4*a* of the ink-jet head 4, the suction pump 23 is operated and inside of the cap member 21 is depressurized. Accordingly, dust and air bubbles, or ink which has become highly viscous due to drying (thick ink) which cause a jetting defect of the nozzle 16 are discharged from the nozzle 16 together with the ink (suction purge).

The wiper 22 is erected at a position more closer to the platen 2 than the cap member 21. After the suction purge, the carriage 3 moves in the scanning direction with a front end of the wiper 22 in contact with the liquid droplet jetting surface 4*a* of the ink jet head 4, and the wiper wipes the ink adhered to the liquid droplet jetting surface 4*a*.

Moreover, the ink-jet printer 1 according to the embodiment is structured to carry out flushing, in which respective inks are jetted from the plurality of nozzles 16 of the ink-jet head 4 at an appropriate timing, in order to prevent the ink inside the nozzles from drying during a period when no printing is carried out on the recording paper P. In the embodiment, the carriage 3 moves to the maintenance position B, and the flushing is carried out in a state of the liquid droplet jetting surface 4*a* of the ink-jet head 4 facing the cap member 21 while leaving an interval (a distance) between the liquid droplet jetting surface 4*a* and the cap member 21 (an uncapped state in which the cap member 21 is not in a close contact with the liquid droplet jetting surface 4*a*), and the ink which is discharged from the nozzle 16 by flushing is received in the cap member 21. A liquid receiving member for flushing which receives the ink discharged from the nozzle 16 at the time of flushing may be provided separately from the cap member 21 for suction purge.

When the maintenance unit 7 is arranged close to the jetting state inspection unit 6, there is a possibility that mist of the ink which has been discharged to the cap member 21 by the suction purge and the flushing may have a negative effect on detection of a jetting defect by the jetting state inspection unit 6. Therefore, in the embodiment, as it has been mentioned above, the jetting state inspection unit 6 and the maintenance unit 7 are arranged at the inspection position A and the maintenance position B respectively, which are on mutually opposite side with respect to the scanning direction, sandwiching the platen 2.

Figure 2:
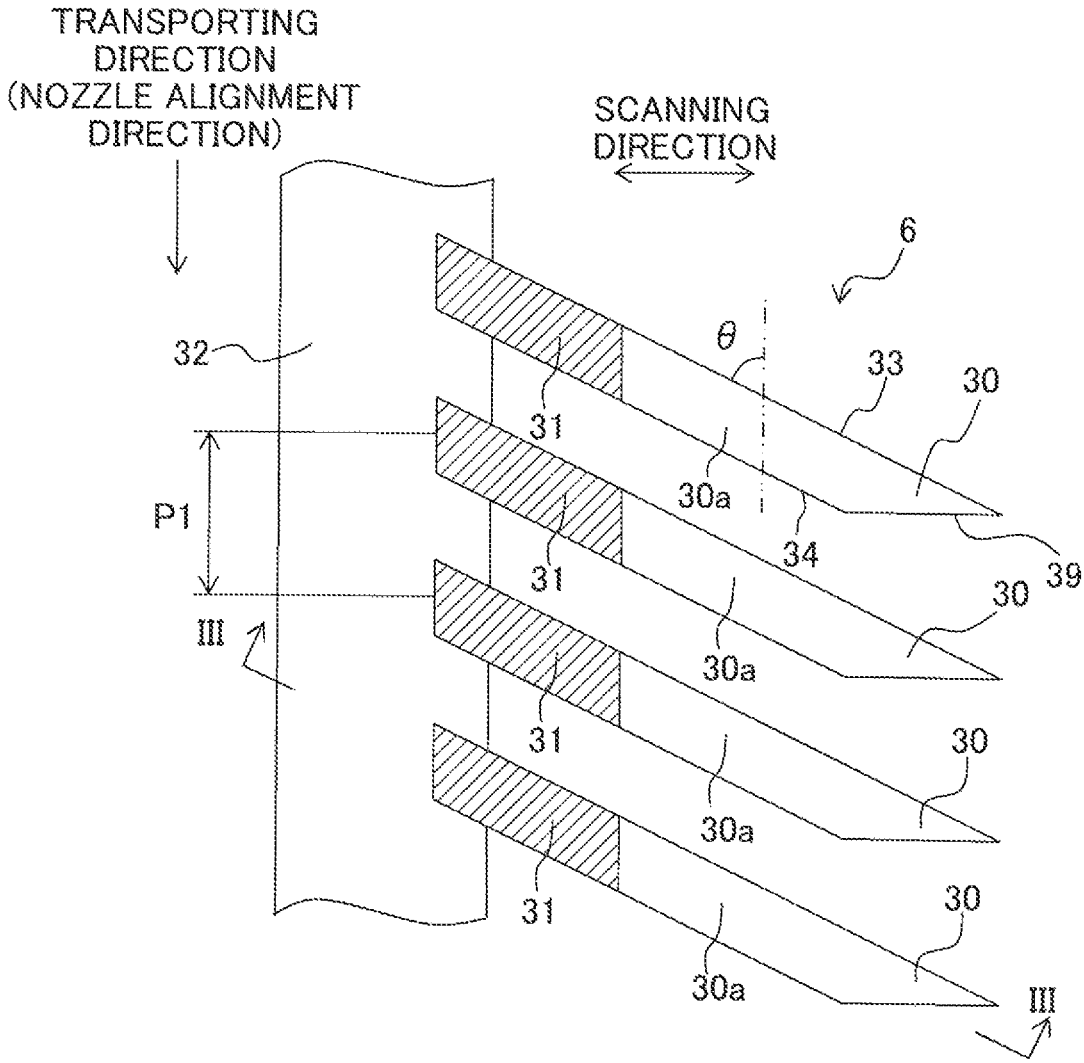
FIG. 2 is a partially enlarged plan view of a jetting state inspection unit.

Next, the jetting state inspection unit 6 will be described below. As shown in FIG. 1 to FIG. 3, the jetting state inspection unit 6 has a plurality of vibration plates 30 and a plurality of piezoelectric elements 31 provided to the plurality of vibration plates 30 respectively.

The vibration plate 30 is a thin plate member (having a width of 200 a thickness of 30 μm, and a length of 2 mm for example) which is long and slender in one direction, and which is formed of silicon or a metallic material such as stainless steel. Moreover, a supporting member 32 which extends in the transporting direction is provided to be fixed to the printer main body 1*a* (refer to FIG. 1). One-end portion of the vibration plate 30 is fixed to an upper surface of the supporting member 32, and is cantilever-supported in a horizontal posture. At the time of inspecting jetting state of the nozzle 16 of the ink-jet head 4, the carriage 3 reaches the inspection position A, and at this time, as shown in FIG. 3, an upper surface of the vibration plate 30 is facing the lower surface (liquid droplet jetting surface 4*a*) of the ink jet head 4 in the vertical direction, and liquid droplets jetted from the nozzle 16 which opens in the liquid droplet jetting surface 4*a* can land on the upper surface of the vibration plate 30. In other words, the vibration plate 30 corresponds to a "liquid droplet landing body" of the present teaching, and the upper surface of the vibration plate 30 is a landing surface 30*a* on which the liquid droplets land.

Moreover, as shown in FIG. 2, the vibration plate 30 extends in a direction making an angle θ with respect to the transporting direction (third direction). In other words, two edges 33 and 34 on both sides (both left and right sides in the diagram) in the width direction of the vibration plate 30 extend upon inclining in the scanning direction (second direction) with respect to the transporting direction (third direction). Moreover, the edges 33 and 34 extend in parallel, and a front end of the edge 33 and a front end of the edge 34 are connected by a front-end edge 39 extending in the scanning direction.

As shown in FIG. 2, the plurality of vibration plates 30 are arranged side-by-side leaving intervals in the nozzle alignment direction (transporting direction) in parallel, and one-end portion of each vibration plate 30 is fixed to the supporting member 32 and is cantilever-supported. In the diagram, the plurality of vibration plates 30 and the supporting members 32 are formed by separate members. However, the plurality of vibration plates 30 and the supporting members 32 may be formed integrally by one member. Moreover, an interval P1 in the transporting direction between the vibration plates 30 is same as a nozzle pitch P0 of one nozzle row of the ink-jet head 4 (refer to FIG. 4). In other words, the plurality of vibration plates 30 are provided corresponding to the plurality of nozzles 16 forming one nozzle row respectively. Furthermore, an interval of (a distance between) front-end edges 39 of the plurality of vibration plates 30 is also same as P1. Moreover, each nozzle 16 in one nozzle row 36A is arranged to jet ink onto an area between the front-end edges 39 of the vibration plates 30 adjacent in the transporting direction. Moreover, the other nozzle row 36B is arranged to be misaligned in the transporting direction by half the nozzle pitch P0 with respect to the nozzle row 36*a*, and each nozzle 16 in the nozzle row 36B is arranged to jet ink onto an area between the front-end edges 39 of the vibration plates 30 adjacent in the transporting direction. Moreover, in FIG. 4, an arrangement is such that for one vibration plate 30, nozzles 16A of one nozzle row 36A and nozzles 16E of the other nozzle row 36B jet the ink.

The piezoelectric element 31 is provided to the vibration plate 30, on an upper surface of an end portion of a side fixed to the supporting member 32. Moreover, the piezoelectric element 31 is a mechano-electrical converting element which is formed of a piezoelectric material such as lead zirconium titanate (PZT), and which outputs an electric signal (voltage signal) upon converting a mechanical deformation which occurs when the vibration plate 30 has deformed to the electric signal. The piezoelectric element 31 may be formed by joining a piezoelectric material in the sheet form which has been baked to the vibration plate 30 by an adhesive, or can also be formed in the thin film form (having a thickness of about 1 μm to 3 μm for example) directly on the vibration plate 30 by a sputtering method or a sol-gel method. Electrodes and wires for voltage detection have been provided on a surface of the piezoelectric element 31. However, for protecting the electrodes and wires and for preventing a short-circuit due to adhering of ink, as shown in FIG. 3, the surface of the piezoelectric element 31 is covered by a coating layer 35 made of an insulating material (in FIG. 2, an insulating layer 35 covering the piezoelectric element 31 is not shown).

Moreover, as a liquid droplet jetted from the nozzle 16 of the ink-jet head 4 lands on the upper surface (landing surface 30*a*) of the vibration plate 30, the vibration plate 30 is deformed (vibrates), and distortion of the piezoelectric element 31 when the vibration plate 30 is deformed is converted to a voltage signal, and is outputted from the piezoelectric element 31. Accordingly, it is possible to detect accurately whether the liquid droplet has landed on the landing surface 30*a* of the vibration plate 30. Here, the piezoelectric element 31 corresponds to "landing detection mechanism" of the present teaching which detects landing of a liquid droplet on the landing surface 30*a* of the vibration plate 30. Moreover, landing of the liquid droplet at any position in the entire area of the landing surface 30*a* of the vibration plate 30 is detected by the piezoelectric element 31. In other words, in the embodiment, the entire area of the landing surface 30*a* (upper surface of a portion at front-end side of the piezoelectric element 31) of the vibration plate 30 corresponds to "detection area" of the present teaching.

Moreover, in the embodiment, as it has been mentioned above, the vibration plate 30 is cantilever-supported by the supporting member 32 at one-end portion thereof. Accordingly, when a liquid droplet lands on the landing surface 30*a*, a deformation (bending) of the vibration plate 30 becomes substantial, and an accuracy of detection of landing of liquid droplets on the vibration plate 30 is improved.

Figure 4:
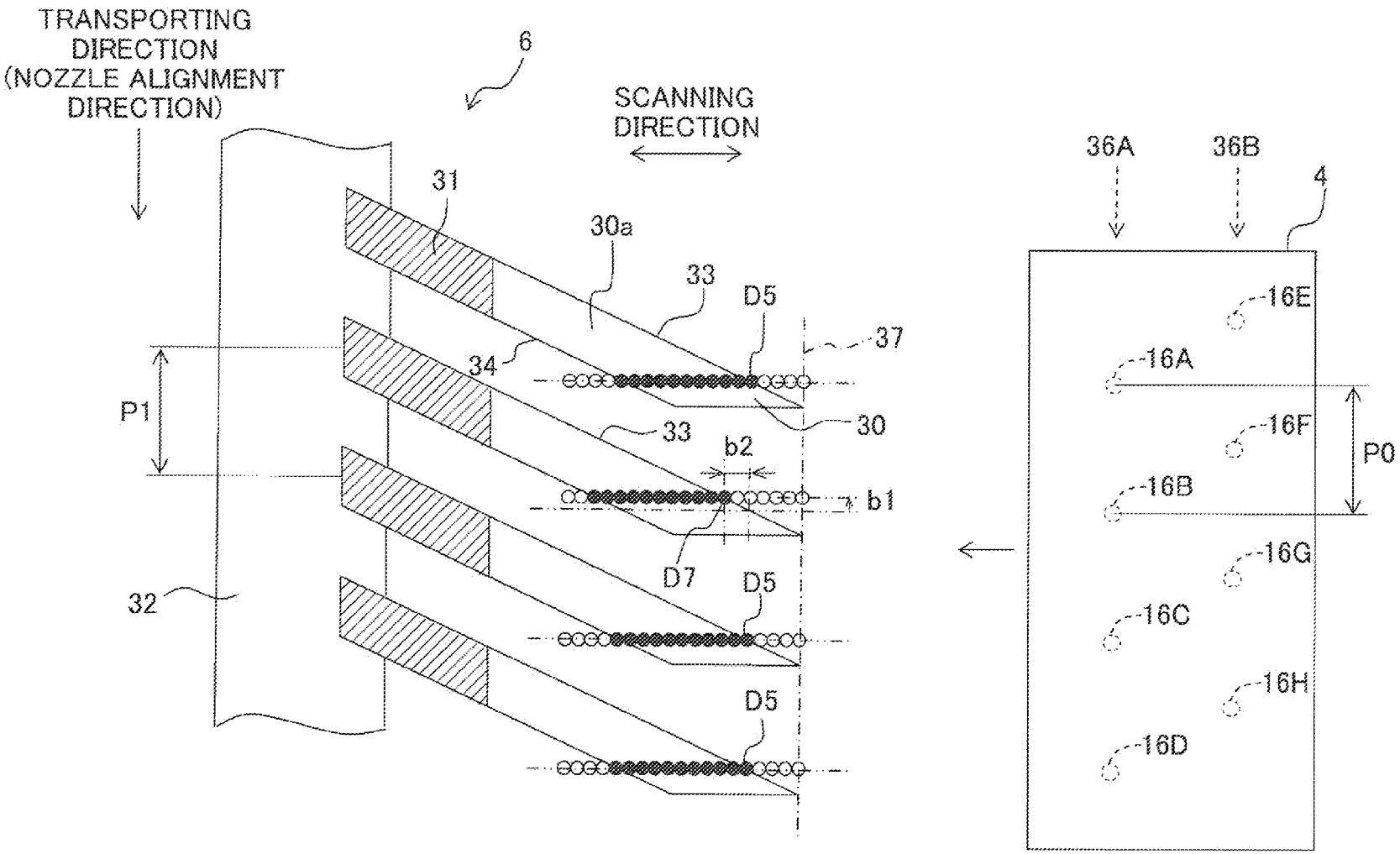
FIG. 4 is a plan view of the jetting state inspection unit at the time of inspecting jetting state.

Next, an action of the jetting state inspection unit 6 at the time of inspecting jetting state will be described while referring to FIG. 4. In FIG. 4, an example in which, the nozzles 16 of the ink-jet head 4 are arranged in a staggered form to form two nozzle rows 36A and 36B. As it has been mentioned briefly earlier, as shown in FIG. 4, the interval P1 between the adjacent vibration plates 30 and the nozzle pitch P0 of one nozzle row 36 are same, and the plurality of vibration plates 30 (four vibration plates) correspond to the plurality of nozzles 16 (four nozzles in the diagram) respectively, which form one nozzle row 36. Moreover, the plurality of piezoelectric elements 31 are provided to base-end side portions of the plurality of vibration plates 30 respectively, which are fixed to the supporting member 32, and it is possible to detect separately the landing of liquid droplets on the plurality of vibration plates 30.

FIG. 4 shows a state in which the jetting state inspection of the nozzle row 36A is being carried out. At the time of inspecting jetting state of the ink jet head 4, the carriage 3 is moved to a position on a slightly outer side of the inspection position A in FIG. 1. In other words, the liquid droplet jetting surface 4*a* of the ink-jet head 4 is let to have a position shifted (misaligned) toward an outer side (right side) of the jetting state inspection unit 6 in the scanning direction. In this state, the carriage 3 (ink-jet head 4) is moved in a direction (leftward in FIG. 4) toward the jetting state inspection unit 6 while jetting the liquid droplets continuously from the nozzles 16 forming the nozzle row 36A at regular intervals of time. As the carriage 3 moves, when the ink-jet head 4 passes transversely across the jetting state inspection unit 6, the plurality of liquid droplets which have been jetted from one nozzle 16 land on the landing surface 30*a* (upper surface of a front-end side portion with respect to the piezoelectric element 31) of the corresponding vibration plate 30, and the landings of the liquid droplets are detected by the piezoelectric element 31. In FIG. 4, liquid droplets landed on the landing surface 30*a* of the vibration plate 30 from among the plurality of liquid droplets which have been jetted continuously (aligned in the scanning direction) from one nozzle are shown as black dots. Accordingly, from whether or not the liquid droplets have landed on the landing surface 30*a* of the vibration plate 30, it is possible to detect misjetting of each nozzle 16.

Furthermore, in the embodiment, it is possible to detect not only misjetting but also a so-called inclined jetting, in which a jetting direction of the nozzle 16 is inclined with respect to a regular (normal) direction as a jetting detect of each nozzle 16.

When the ink-jet head 4 is moved in the scanning direction with respect to the vibration plate 30 while jetting the liquid droplets from the nozzles 16, from a change in an output voltage of the piezoelectric element 31, it is possible to detect a timing at which the liquid droplets start landing on the landing surface 30*a* of the vibration plate 30 (timing at which a liquid droplet has landed on the edge 33 on the right side of the vibration plate 30), or, a timing at which the landing on the landing surface 30*a* ends (timing at which the liquid droplet has landed on the edge 34 on the left side of the vibration plate 30). As it has been mentioned above, the two edges 33 and 34 (first edges) in the width direction of the vibration plate 30 extend to be inclined toward the scanning direction with respect to the transporting direction (third direction) which is orthogonal to the scanning direction (second direction) of the carriage 3. When the nozzles 16 are aligned in a row in the transporting direction as shown in FIG. 1, the third direction coincides with the nozzle alignment direction (first direction).

In the example in FIG. 4, jetting state from the three nozzles 16A, 16C, and 16D out of the four nozzles 16A, 16B, 16C, and 16D (hereinafter, "nozzles 16A to 16D") which form the nozzle row 36A is normal in which misjetting and inclined jetting are not occurred. Whereas, the jetting direction of droplets from the second nozzle 16B from the top is inclined in the nozzle alignment direction (upward direction in the diagram) with respect to the regular (normal) direction, and a position of the liquid droplet is shifted only by b1 in the nozzle alignment direction (upstream side of the transporting direction: upward direction in the diagram) as compared to the three nozzles 16A, 16C, and 16D which are normal, as shown by an arrow.

At this time, since the edge 33 of the vibration plate 30 is inclined toward the scanning direction with respect to the transporting direction, regarding the nozzle 16B having the inclined jetting, the timing of landing of the liquid droplet on the edge 33 of the vibration plate is delayed as compared with the other three nozzles 16A, 16C, and 16D, the jetting directions of which are not inclined. Concretely, when there is no inclined jetting (nozzles 16A, 16C, and 16D), a liquid droplet D5 which is jetted fifth while moving from a predetermined jetting-start position (position in the scanning direction shown by vertical alternate long and short dashed line 37 in the diagram) lands on the edge 33 of the vibration plate 30. On the other hand, regarding the nozzle 16B having the inclined jetting, a liquid droplet D7 which is jetted seventh after the liquid droplet D5 lands on the edge 33 of the vibration plate 30. Moreover, the position of the ink-jet head 4 in the scanning direction at a timing at which the liquid droplet D5 jetted fifth lands and the position of the ink-jet head 4 in the scanning direction at a timing at which the liquid droplet D7 jetted seventh lands differ only by a distance b2. In other words, a difference in timing of landing on the edge 33 can be obtained from the position in the scanning direction of the ink-jet head 4 when the liquid droplets have landed on the edge 33 of the vibration plate 30.

Consequently, it is possible to detect the inclined jetting of the nozzle 16 from the position, of the ink-jet head 4 in the scanning direction, which has been detected by the photosensor 25 (refer to FIG. 1: position detection mechanism) when a liquid droplet is detected to have landed on the edge 33 of the vibration plate 30 by the piezoelectric element 31. The inclined jetting of the nozzle 16 may be detected from a difference in timing of landing on the other edge 34 in the width direction of the vibration plate 30 (timing when landing of liquid droplet on the vibration plate 30 ends).

Although, FIG. 4 shows the example when the jetting direction from the nozzle 16 is inclined in the transporting direction (the nozzle alignment direction), even when the jetting direction is inclined in the scanning direction, the timing of landing of the liquid droplet on the edge 33 (34) of the vibration plate 30 is different (mismatched) as a matter of course. Consequently, when the jetting direction from the nozzle 16 is inclined, it is possible to detect the direction in which the jetting is inclined irrespective of whether the jetting direction is inclined in the transporting direction or in the scanning direction.

However, considering the jetting inclined in the transporting direction and the jetting inclined in the scanning direction, the jetting inclined in the transporting direction has a substantial effect on printing quality. In other words, a row of dots in the transporting direction is formed by the liquid droplets being jetted simultaneously from the plurality of nozzles 16 in one nozzle row 36, and a row of dots in the scanning direction is formed by the liquid droplets being jetted continuously from one nozzle 16. Consequently, when the jetting from a certain nozzle 16 is inclined in the transporting direction, regarding a row of dots in the transporting direction on the recording paper P, an interval between a dot formed by the nozzle 16 having inclined jetting and a dot formed by a nozzle 16 which is normal and adjacent to the nozzle 16 having inclined jetting becomes substantially wide, thereby causing a gap (white stripes extended in the scanning direction), and printing quality is degraded substantially. On the other hand, when the jetting is inclined in the scanning direction, a position of the overall row of dots in the scanning direction is slightly shifted in the scanning direction. Since there is no change in the interval of dots, the effect on the printing quality is small.

From the abovementioned reason, it is preferable to detect assuredly the jetting inclined in the transporting direction in particular. Accordingly, in the embodiment, as shown in FIG. 2, an angle θ made by the edge 33 (34) of the vibration plate 30 with respect to the transporting direction is 45° or more, but less than 90°. When the angle θ is a large angle such as 45° or more, but less than 90°, an amount of position shift (b2 in FIG. 4) when landing on the edge 33 (34) is same as or more than an amount of position shift in the transporting direction (b1 in FIG. 4). Consequently, an accuracy of detection of jetting inclined in the transporting direction is improved.

Moreover, the plurality of vibration plates 30 respectively correspond to the plurality of nozzles 16 which form one nozzle row 36, and it is possible to detect separately the landings of liquid droplets on the plurality of vibration plates 30 by the plurality of piezoelectric elements 31. Therefore, it is possible to carry out simultaneously inspection of jetting from the plurality of nozzles 16 which form one nozzle row 36. In FIG. 4, two nozzle rows 36A and 36B are shown, and in this case, after the jetting inspection is carried out simultaneously for the plurality of nozzles 16 in any one of the nozzle rows 36 (36A or 36B), the jetting inspection for the nozzles 16 in the remaining nozzle row 36 may be carried out continuously. Moreover, it is also possible to carry out an inspection for one nozzle 16 in a case of inspecting jetting state of a specific one nozzle, instead of carrying out an inspection per one nozzle row 36.

Next, a control system of the ink-jet printer 1 including the control unit 8 as a main component will be described below in detail by referring to a block diagram in FIG. 5. The control unit 8 of the ink-jet printer 1 shown in FIG. 5 is provided with a micro computer which includes, for example, a CPU (Central Processing Unit), a ROM (Read Only Memory) in which various computer programs and data for controlling the overall operation of the ink jet printer 1 are stored, and a RAM (Random Access Memory) which stores temporarily data to be processed by the CPU. Various controls which will be described below are carried out by executing the computer program stored in the ROM by the CPU. Or, the control unit 8 may be a hardware unit in which various circuits including an arithmetic circuit are combined.

The control unit 8 has a print control section 60 including: a head control section 61 which controls the ink-jet head 4; a carriage control section 62 which controls the carriage driving motor 15 which drives the carriage 3 in the scanning direction; and a transport control section 63 which controls the transport mechanism 5. The print control section 60 controls each of the ink-jet head 4, the carriage driving motor 15, and the transport mechanism 5, based on data (print data) related to image etc. to be printed, which has been inputted from a PC (personal computer) 70, to carry out printing on the recording paper P.

Moreover, the control unit 8 includes: a maintenance control section 65 which controls a series of maintenance operations including the suction purge which has been described above, by controlling the cap driving motor 26 which drives the cap member 21 to ascend and descend and the suction pump 23 of the maintenance unit 7; and a flushing control section 66 which controls the flushing of the ink-jet head 4. Furthermore, the control unit 8 has a jetting state judgement section 67 (judging section) which judges the jetting state of the plurality of nozzles 16 of the ink-jet head 4.

A function of each of the print control section 60, the maintenance control section 65, the flushing control section 66, and the jetting state judgement section 67 is practically realized by an operation of the abovementioned micro computer or an operation of various circuits including the arithmetic circuit.

Next, the jetting state judgement section 67 will be described below in detail. The jetting state judgement section judges jetting state of each of the plurality of nozzles 16 of the ink-jet head 4 based on output voltage signals of the plurality of piezoelectric elements 31 of the jetting state inspection unit 6 and information of position of the carriage 3 (ink-jet head 4) in the scanning direction which is detected by the photosensor 25.

As shown in FIG. 4, when the ink-jet head 4 is moved in the scanning direction to pass over the plurality of vibration plates 30 of the jetting state inspection unit 6 while jetting liquid droplets continuously from the nozzles 16 of the ink-jet head 4, in a case in which landings of liquid droplets from a certain nozzle 16 on the corresponding vibration plate 30 are not detected at all by the piezoelectric element 31, the jetting state judgement section 67 judges that there is misjetting from the certain nozzle 16.

Moreover, in a case in which landings of liquid droplets from a certain nozzle 16 are detected by the piezoelectric element 31, and in which the position of the ink-jet head 4 in the scanning direction when a liquid droplet from the certain nozzle 16 landed on the edge 33 (34) of the vibration plate 30 is shifted in the scanning direction as compared with a case in which the jetting direction of liquid droplets is regular (normal), the jetting state judgement section 67 judges that the jetting from the certain nozzle 16 is inclined.

A signal of a judgment result by the jetting state judgement section 67 is sent to the maintenance control section 65 and the flushing control section 66. Moreover, when a judgment that there is a jetting defect (misjetting or inclined jetting) in a certain nozzle 16 has been made by the jetting state judgement section 67, the suction purge is performed by controlling the suction pump 23 of the maintenance unit 7 by the maintenance control section 65. Or, the flushing of the nozzle 16 is performed by controlling the ink-jet head 4 by the flushing control section 66. In other words, the suction pump 23 which performs the suction purge and the actuator for jetting liquid droplets which is provided in the ink-jet head 4 and which makes the nozzle 16 flush correspond to a recovery mechanism in the present teaching.

In such manner, by judging the jetting state of each of the plurality of nozzles 16 and by performing the recovery operation only when there is a jetting defect, it is possible to reduce unnecessary recovery operation, and to control an amount of ink which is discharged in the recovery operation.

In the embodiment, as the recovery operation of the jetting performance of the nozzle 16, it is possible to perform two types of recovery operations namely the suction purge and the flushing, and based on the judgment result of the jetting state judgement section 67, the most suitable recovery operation is to be selected upon taking into account the degree of jetting defect. For instance, unlike the suction purge in which the ink is sucked and discharged simultaneously upon covering the plurality of nozzles by one cap member 21, it is also possible to perform the flushing for one nozzle 16 at a time. Accordingly, when the number of nozzles 16 having jetting defects is small and is less than a predetermined number, the flushing may be carried out only for the nozzles 16 having the jetting defects, and only when the number of nozzles 16 having jetting defects is large and is greater than the predetermined number, the suction purge may be carried out to eliminate the jetting defects of the plurality of nozzles 16 at a time.

Moreover, the suction purge is an operation of discharging forcibly an ink inside the nozzle 16 by applying a pressure (suction force) from outside by the suction pump 23 which is connected to the cap member 21, and as compared to the flushing in which the liquid droplets are jetted from the nozzle 16 by an actuator which is used for jetting the liquid droplets at the time of recording, the force of discharge (discharge performance) from the nozzle 16 in the suction purge is quite strong (high). However, since the force of discharge from the nozzle 16 in the suction purge is quite strong, an amount of waste ink becomes larger as compared to an amount of waste ink in the flushing. Meanwhile, in misjetting in which the liquid droplets are not jetted at all, the jetting defect is severer than the inclined jetting in general, because the drying of ink inside the nozzle 16 may have progressed or an air bubble might have entered an ink channel inside the ink-jet head. Thus, a substantial discharge force is necessary for eliminating the misjetting. Therefore, when the number of nozzles 16 for which the misjetting has been detected is more than a predetermined number, the degree of jetting defect may be judged to be exceeding and the suction purge may be performed, and when the number of nozzles 16 for which the misjetting has been detected is not more than the predetermined number, the flushing may be performed to suppress the amount of waste ink.

Moreover, when the misjetting or the inclined jetting has been judged for a certain nozzle 16, firstly, the flushing with weak discharge force (first recovery operation with first liquid discharge performance) may be carried out. Thereafter, when a jetting defect is detected by inspecting the jetting state of the certain nozzle once again, the suction purge with strong discharge force (second recovery operation with second liquid discharge performance which is higher than the first liquid discharge performance) may be carried out. By doing so, it is possible to suppress the amount of waste ink in the recovery operation. Furthermore, when a jetting defect is detected by inspecting the jetting state even after the suction purge, a judgment may be made that there is a jetting defect which can not be recovered by the suction purge, and an error may be notified to the user to encourage the user to replace the ink-jet head 4.

Next, modified embodiments in which, various modifications are made in the embodiment will be described below. However, same reference numerals will be used for components having a similar structure as in the embodiment, and the description of such components will be omitted appropriately.

In the embodiment, the shift of the landing timing of a liquid droplet on the edge 33 (34), of the vibration plate 30, which is inclined with respect to the transporting direction is detected based on the position of the ink-jet head 4 in the scanning direction when the liquid droplet has landed on the edge 33 (34). However, it is also possible to detect the shift of the landing timing of the liquid droplet on the edge 33 (34) as described below (first modified embodiment).

For instance, at the time of carrying out the jetting state detection, a time period from jetting of the first liquid droplet at a predetermined jetting-start position (position in the scanning direction shown by the alternate long and short dashed line in FIG. 4) till detection of landing on the edge 33 (34) may be measured, and based on the time lag with respect to a normal case in which there is no inclined jetting, the judgment of whether or not there is an inclined jetting may be made. Or, the number of liquid droplets which have been jetted at a fixed time interval from jetting of the first liquid droplet at the predetermined jetting-start position till detection of landing on the edge 33 (34) (in other words, a liquid droplet jetted at what number has landed) may be measured, and the judgment of whether or not there is an inclined jetting based on the number of jetting of the liquid droplets at the timing of the landing on the edge 33 (34) may be made.

Figure 6:
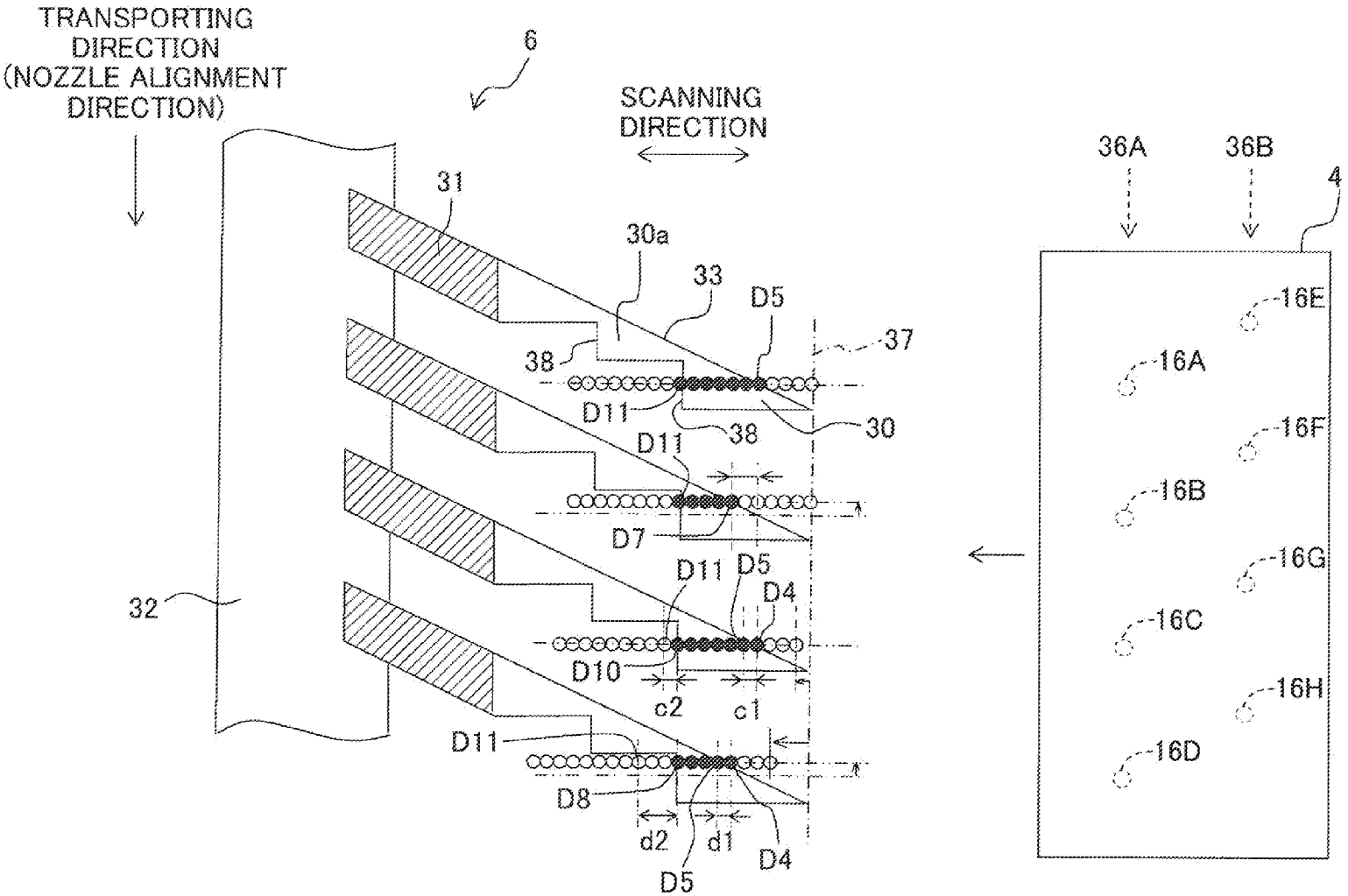
FIG. 6 is a partially enlarged plan view of a jetting state inspection unit according to a second modified embodiment of the present teaching.

1] As it has been described above, the jetting inclined in the transporting direction has substantial effect on printing quality as compared to the jetting inclined in the scanning direction. However, it is not possible to detect distinctively the jetting inclined in the transporting direction and the jetting inclined in the scanning direction only by the edge 33 (34) of the vibration plate 30 of the embodiment, which is inclined with respect to the transporting direction. Therefore, by providing another edge which has an inclination angle with respect to the transporting direction different from that of the edge 33 (34), it is possible to distinguish the jetting inclined in the transporting direction and the jetting inclined in the scanning direction. For instance, as shown in FIG. 6, the vibration plate 30 may be a plate which has an edge 38 (second edge) parallel to the transporting direction (orthogonal to the scanning direction) in addition to the edge 33 (first edge) inclined toward the scanning direction with respect to the transporting direction (second modified embodiment). At the edge 33 which is inclined, there is a shift of the landing timing of the liquid droplet due to any of the jetting inclined in the transporting direction and the jetting inclined in the scanning direction. However, since the edge 38 being parallel to the transporting direction, there is no shift of the landing timing of the liquid droplet due to the jetting inclined in the transporting direction. Consequently, it is possible to distinguish the jetting inclined in the transporting direction and the jetting inclined in the scanning direction.

Distinguishing the inclined jetting using the two types of edges 33 and 38 will be described below more concretely. In FIG. 6, nozzle 16A is a nozzle with no inclined jetting, nozzle 16B is a nozzle the jetting direction of which is inclined in the transporting direction (upward direction in the diagram), nozzle 16C is a nozzle the jetting direction of which is inclined in the scanning direction (leftward direction in the diagram), and nozzle 16D is a nozzle the jetting direction of which is inclined in both the transporting direction (upward direction in the diagram) and the scanning direction (leftward direction in the diagram).

In the nozzle 16A with no inclined jetting, a liquid droplet D5 which is jetted fifth from a predetermined jetting-start position (position in the scanning direction depicted by the alternate long and short dashed line 37 in the diagram) lands on the edge 33 (first edge) of the vibration plate 30, which is inclined with respect to the transporting direction, and a liquid droplet D11 which is jetted eleventh lands on the edge 38 (second edge) which is parallel to the direction in which the nozzles are aligned. In the nozzle 16B the jetting direction of which is inclined in the transporting direction, the timing of landing on the edge 33 is shifted (seventh liquid droplet D7) but the timing of landing on the edge 38 does not differ from the timing of landing from the nozzle 16A.

In the nozzle 16C the jetting direction of which is inclined in the scanning direction, a timing of landing on the edge 33 (fourth liquid droplet D4) is shifted, and furthermore, a timing of landing on the edge 38 is also shifted (tenth liquid droplet D10). Moreover, also in the nozzle 16D the jetting direction of which is inclined in both the transporting direction and the scanning direction, the timing of landing on the edge 33 is shifted (fourth liquid droplet D4), and furthermore, the timing of landing on the edge 38 is also shifted (eighth liquid droplet D8).

However, with respect to the nozzle 16C, since the jetting direction is inclined only in the scanning direction, there is no difference in timing of landing on the edge 33, due to the jetting inclined in the transporting direction. Consequently, the difference in timing of landing on the edge 33 (amount c1 of position-shift of liquid droplet) and the difference in timing of landing on the edge 38 (amount c2 of position-shift of liquid droplet) are same. Whereas, with respect to the nozzle 16D, since there is difference in timing of landing on the edge 33 due to the jetting inclined in the transporting direction, the difference in timing of landing on the edge 33 (amount d1 of position-shift) which is inclined with respect to the transporting direction and the difference in timing of landing on the edge 38 (amount d2 of position-shift) which is parallel to the transporting direction are different.

Consequently, the jetting state judgement section 67 detects the differences in the landing timings of the liquid droplets on the edges 33 and 38, based on the positions of the inkjet head 4 in the scanning direction at a timing at which a liquid droplet lands on the edge 33 and a timing at which another liquid droplet lands on the edge 38. When both are same, the jetting state judgement section 67 makes a judgment that the jetting is inclined only in the scanning direction, and when both are different, the jetting state judgement section 67 can make a judgment that the jetting is inclined at least in the transporting direction. Even if the second edge 38 is not parallel to the transporting direction (third direction), if the second edge 38 intersects the scanning direction and extends in a direction different from the extending direction of the first edge 33 (34), the difference in the landing timing on the first edge 33 (34) and the difference in the landing timing on the second edge 38 when the jetting is inclined are different. Accordingly, it is possible to distinguish the jetting inclined in the transporting direction and the jetting inclined in the scanning direction, based on the differences in the respective landing timings. However, as shown in FIG. 6, in the case in which the second edge 38 is parallel to the transporting direction, the distinction of the inclined jetting can be carried out easily.

In FIG. 6, two edges 38 parallel to the transporting direction are formed on a left side of the vibration plate 30 side-by-side in the longitudinal direction of the vibration plate 30. These two edges 38 are provided for detecting jetting for the two nozzle rows 36A and 36B arranged in staggered (zigzag) form, with positions of the nozzles 16 in the alignment direction shifted by a half pitch. In FIG. 6, the two nozzles 16A and 16E belonging to the two nozzle rows 36A and 36B respectively are arranged to jet liquid droplets on areas corresponding to different edges 38 of the same vibration plate 30. Moreover, it is preferable that the edges 33 and 38 of the vibration plate 30 are to be set such that after the landing of liquid droplets jetted from one of the two nozzles 16A and 16E which jet the liquid droplets on the same vibration plate 30 is over, the landing of liquid droplets from the other nozzle 16 starts. Moreover, the number of edges 38 is to be determined according to the number of nozzle rows 36 in which the positions of the nozzles 16 in the alignment direction are mutually different.

Figure 7:
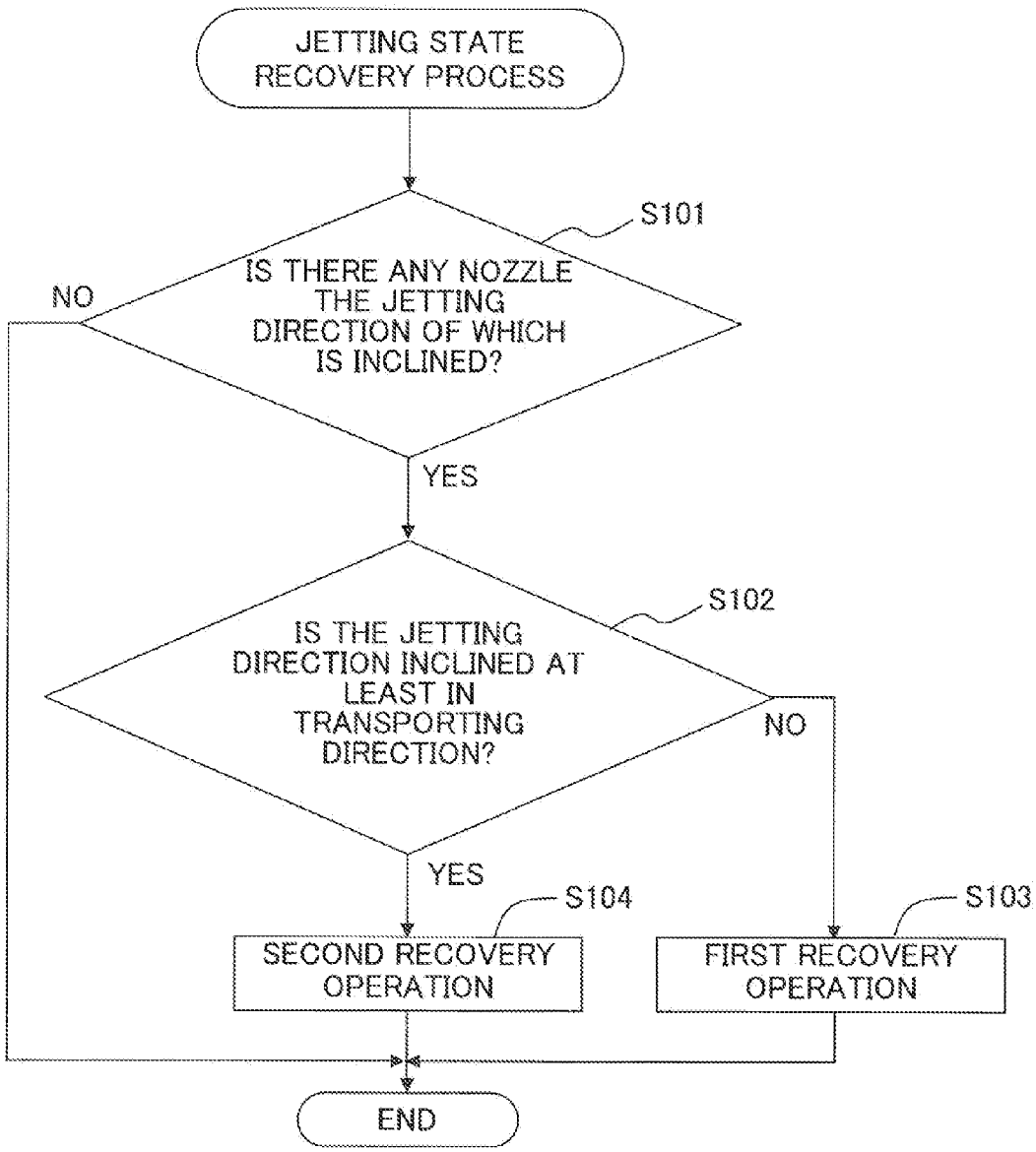
FIG. 7 is a flowchart showing jetting state recovery process when the jetting state inspection unit according the second modified embodiment has been used.

As it has been described above, since the jetting state judgement section 67 distinguishes whether or not the jetting direction of each of the nozzles 16 is inclined at least in the transporting direction, it is possible to adapt a method which is suitable for the direction in which the jetting is inclined. For instance, as it has been described in the embodiment, when the two types of recovery operations (suction purge and flushing) with different ink-discharge forces (performances) are performable, it is possible to perform a jetting state recovery process as shown in FIG. 7. Firstly, the jetting judgment section 67 makes a judgment of whether or not the direction of jetting is inclined for each nozzle 16 (step S101). When the jetting direction of each nozzle 16 is not inclined (No at step S101), the jetting state recovery process is terminated. When there is a nozzle 16 for which the jetting direction is inclined (Yes at step S101), in a case in which a judgment is made that the jetting direction is inclined only in the scanning direction (No at step S102), since an effect is minor even when the inclination of the jetting direction is not eliminated completely, the recovery operation with a weak ink discharge force (flushing, first recovery operation) is carried out (step S103), and the jetting state recovery process is terminated. Whereas, in a case in which a judgment is, made that the jetting direction from a certain nozzle 16 is inclined at least in the transporting direction (Yes at step S102), the recovery operation with a strong ink discharge force (suction purge, second recovery operation) is carried out (step S104) to eliminate assuredly the inclined jetting, and the jetting state recovery process is terminated. Or, an arrangement may be made such that when a judgment is made that the jetting is inclined only in the scanning direction, the recovery operation is not to be performed.

2] A structure of the jetting state inspection unit 6 is not restricted to the structure in the embodiment, and it is possible to make appropriate changes as shown in the example described below.

Third Modified Embodiment

Figure 8:
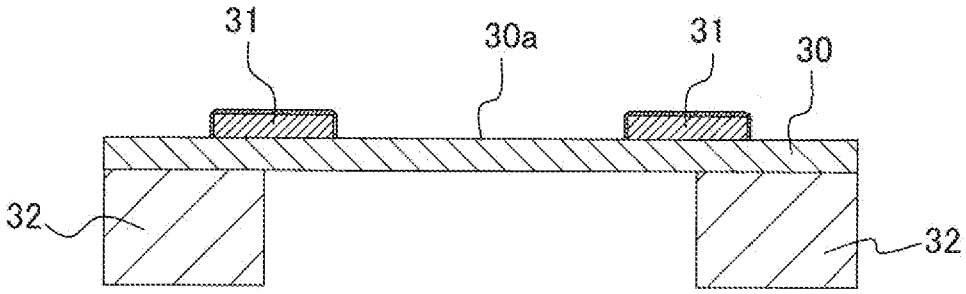
FIG. 8 is a cross-sectional view of a jetting state inspection unit according to third modified embodiment of the present teaching.

As shown in FIG. 8, two end portions of the vibration plate 30 may be fixed to the supporting member 32, and the vibration plate 30 may be a so-called center-impeller supported. In this case, for detecting assuredly a deformation of the vibration plate 30, it is preferable that each the two end portions fixed to the supporting member 32 is provided with the piezoelectric element 31.

Fourth Modified Embodiment

As shown in FIG. 9, an interval (a distance) P2 of (between) the plurality of vibration plates 30 lined up in the transporting direction may be let to be larger than the nozzle pitch P0 of one nozzle row 36. In this case, even though the vibration plates 30 do not correspond one-to-one with respect to the plurality of nozzles 16 respectively forming a nozzle row 36, as it is possible to detect separately the landing of liquid droplets from the plurality of nozzles 16 by the plurality of piezoelectric elements 31 provided to the plurality of vibration plates 30, it is possible to carry out inspection of jetting simultaneously for the same number of nozzles 16 as the number of vibration plates 30. Particularly, when the degree of integration of the nozzles 16 is high, and the nozzle pitch P0 is extremely small, as it becomes difficult to line up the plurality of vibration plates 30 at an interval same as such nozzle pitch P0, it is preferable to adapt a structure in which the number of vibration plates 30 is reduced to a small number, with respect to the number of nozzles 16 as shown in FIG. 9.

Fifth Modified Embodiment

Figure 10:
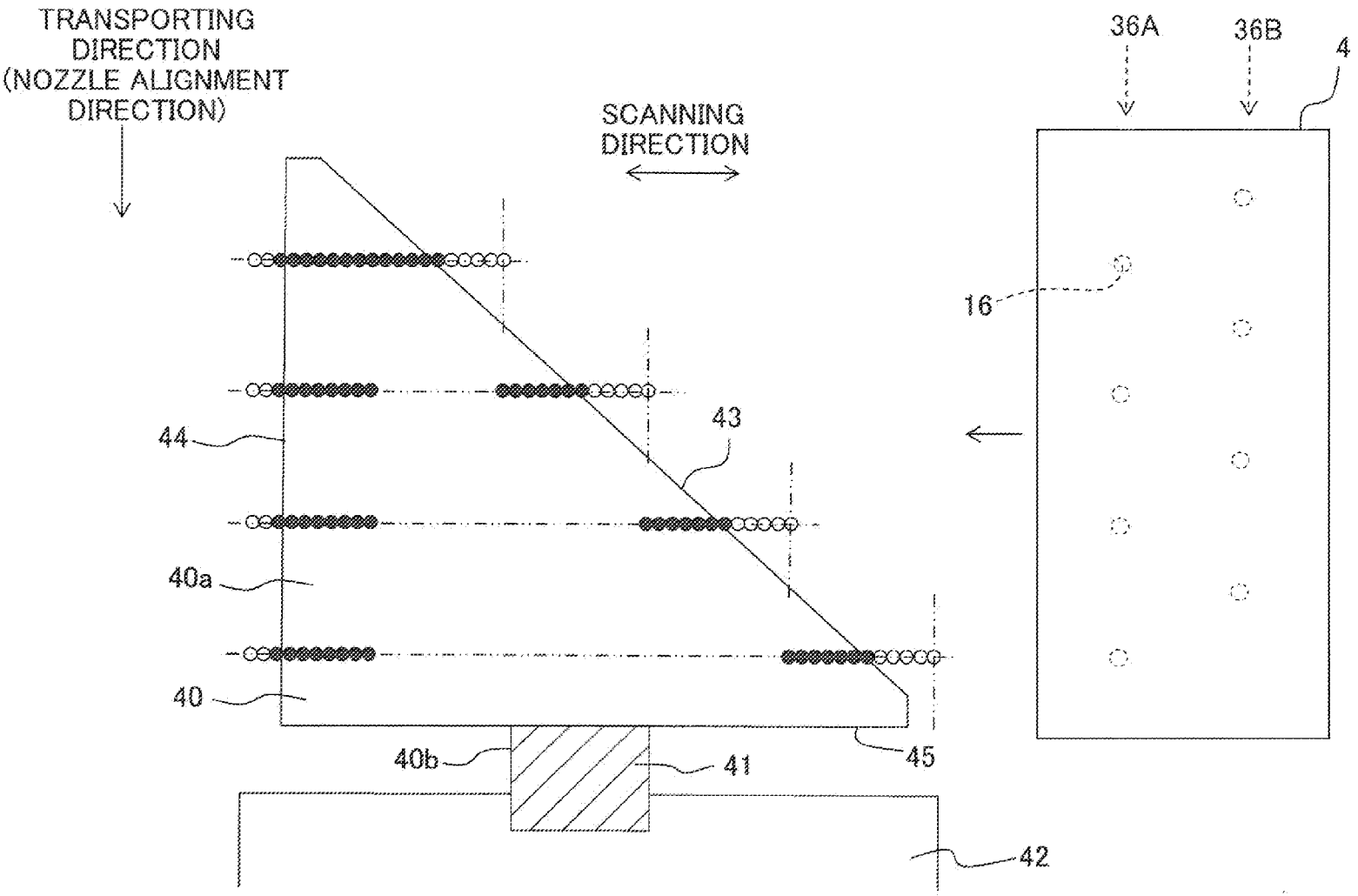
FIG. 10 is a plan view of a jetting state inspection unit according to a fifth modified embodiment of the present teaching.

Or, an arrangement may be made such that jetting of one nozzle row is detected by one large vibration plate. For instance, as shown in FIG. 10, a vibration plate 40 which is cantilever-supported by a supporting member 42 is a member in the form of a plate having a planar shape of a substantially right-angled triangle, and two sides 44 and 45 which are perpendicular are arranged parallel to the transporting direction and the scanning direction respectively. In this case, an oblique side 43 of the vibration plate 40 is inclined toward the scanning direction with respect to the transporting direction, and becomes the first edge of the present teaching. The orthogonal side 44 which is parallel to the transporting direction of the vibration plate 40 becomes the second edge of the present teaching. A length of the oblique side 43 (first edge) in the transporting direction and a length of the orthogonal side 44 (second edge) in the transporting direction (vertical length in the diagram) are longer than (a length of) the nozzle row 36. Liquid droplets which are jetted from each of the plurality of nozzles 36 forming one nozzle row 36, land on an area between the oblique side 43 and, the orthogonal side 44 on an upper surface of one vibration plate 40.

One piezoelectric element 41 is provided to a coupling portion 40*a* of the vibration plate 40 coupling with the supporting member 42, and landing of the liquid droplets on the vibration plate 40 is detected by this piezoelectric element 41. Here, a width (length in the scanning direction) of a coupling portion 40*b* of the vibration plate 40 is narrow as compared to a landing surface 40*a* of the vibration plate 40 so that the vibration plate 40 deforms substantially when liquid droplets have landed on the vibration plate 40. In a structure in FIG. 10, when the liquid droplets are jetted simultaneously from the plurality of nozzles 16 on to the vibration plate 40, since it is not possible to detect upon distinguishing by one piezoelectric element 41 as to the liquid droplets from which nozzle 16 have landed, inspection of jetting is to be carried out for each nozzle.

Sixth Modified Embodiment

As a means for detecting the deformation of the vibration plate when the liquid droplets have landed, apart from the piezoelectric element, it is also possible to use a strain gauge or an acceleration sensor. Moreover, it is also possible to form the vibration plate of a mechano-luminescent (stress-luminescent) material which emits light corresponding to a mechanical external force, and to detect an amount of light emitted by the vibration plate. Furthermore, it is also possible to detect the deformation of the vibration plate by detecting a sound pressure level at the time of vibrating (deformation) of the vibration plate by a sound detector element (such as a high-sensitivity mic).

3] In the embodiment, the landing of the liquid droplets on the landing surface 30*a* of the vibration plate 30 have been detected by detecting the deformation of the vibration plate (liquid droplet landing body) by the piezoelectric element. However, an arrangement may also be such that a landing detection mechanism detects directly the ink landed on the landing surface of the liquid droplet landing body as described below.

Seventh Modified Embodiment

Figure 11:
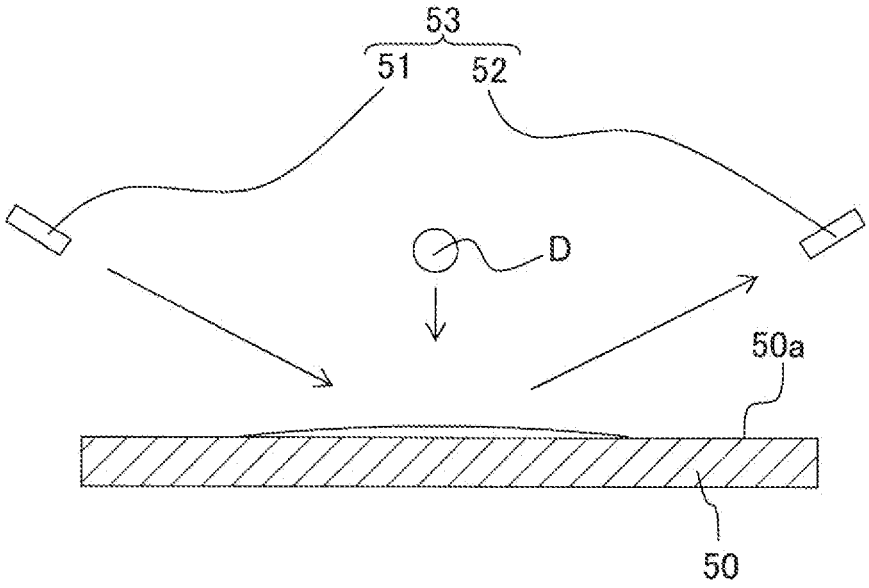
FIG. 11 is a cross-sectional view of a liquid droplet landing body according to a seventh modified embodiment of the present teaching.

As shown in FIG. 11, when a liquid droplet D has landed on a landing surface 50*a* of a liquid droplet landing body 50, a reflectivity and an angle of reflection of light on the landing surface 50*a* change, compared to a state before the liquid droplet has landed. Therefore, the jetting detection unit may be a unit which includes an optical sensor 53 having a light emitting element 51 which irradiates light toward the landing surface 50*a* of the liquid droplet landing body 50, and a light receiving element 52 which receives light reflected at the landing surface 50*a*, and which detects whether the liquid droplet D has landed on the landing surface 50*a*, from a change in an amount of light received by the light receiving element 52.

Eighth Modified Embodiment

Figure 12:
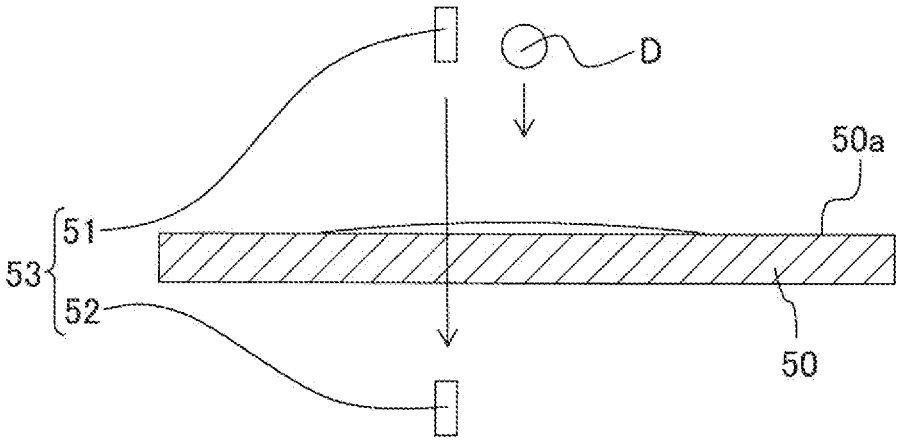
FIG. 12 is a cross-sectional view of a liquid droplet landing body according to an eighth modified embodiment of the present teaching.

When the liquid droplet landing body 50 is made of a material (such as glass and acrylic resin) which allows light to pass through in a direction of thickness, as shown in FIG. 12, when a liquid droplet D of a color ink having a light shielding property has landed on the landing surface 50*a* of the liquid droplet landing body 50, a transmittance of light of the liquid droplet landing body 50 is degraded as compared to a state before landing of the liquid droplet D. Therefore, the jetting detection unit may be a unit which includes an optical sensor 53 having a light receiving element 52 and a light emitting element 51 arranged to sandwich the liquid droplet landing body 50 in a direction orthogonal to the landing surface 50*a*, and which detects whether the liquid droplet D has landed on the landing surface 50*a*, from a change in an amount of light received by the light receiving element 52.

Ninth Modified Embodiment

Figure 13:
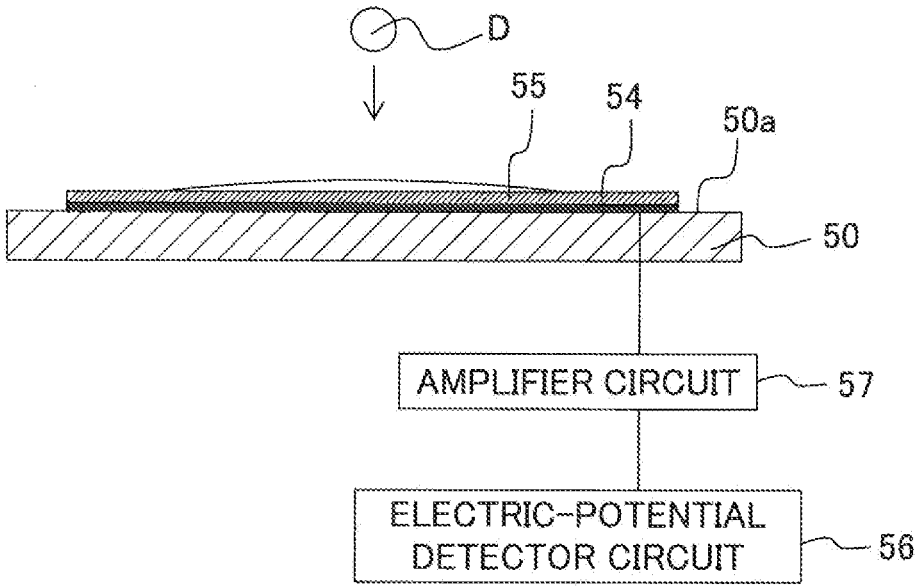
FIG. 13 is a cross-sectional view of a liquid droplet landing body according to a ninth modified embodiment of the present teaching.

Generally, a liquid droplet which is jetted from the nozzle 16 of the ink-jet head 4 carries an electric charge. Therefore, as shown in FIG. 13, when an electrode 54, and an insulating layer 55 which covers the electrode 54 are provided on the landing surface 50*a* of the liquid droplet landing body 50, as a liquid droplet D which is charged electrically has landed on the insulating layer 55, an electric potential of the electrode 54 changes slightly due to dielectric polarization of the insulating layer 55. Therefore, the jetting detection unit may be a unit having an electric-potential detector circuit 56 which detects the electric potential of the electrode 54, and which detects whether the liquid droplet D has landed on the landing surface 50*a*, by detecting a change in the electric potential of the electrode in the electric-potential detector circuit 56. An amount of electric charge on the liquid droplet D being extremely small, and also the change in the electric potential of the electrode 54 being minute, it is advisable to input the change in the electric potential of the electrode 54 to the electric-potential detector circuit 56 upon amplifying the change in the electric potential of the electrode 54 by an amplifier circuit 57.

Tenth Modified Embodiment

Figure 14:
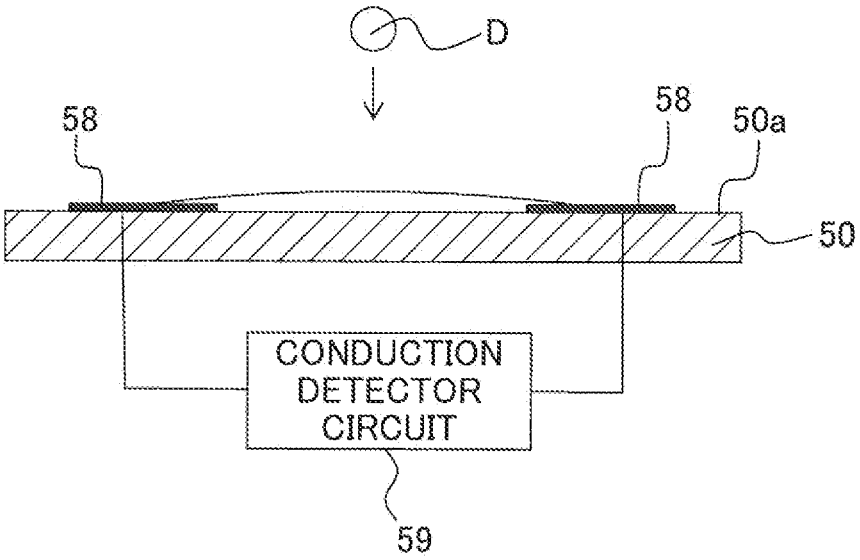
FIG. 14 is a cross-sectional view of a liquid droplet landing body according to a tenth modified embodiment of the present teaching.

In a case in which, the ink jetted from the ink-jet head 4 is electroconductive, as shown in FIG. 14, when two electrodes 58 are provided at a distance on the landing surface 50*a* of the liquid droplet landing body 50, when a liquid droplet D has landed between the two electrodes 58 on the landing surface 50*a*, the two electrodes 58 are brought into conduction and an electric current flows between the two electrodes 58. Therefore, the jetting detection unit may be a unit which has a conduction detector circuit 59 which detects conduction between the two electrodes 58, and which makes a judgment of whether or not the liquid droplet has landed on the landing surface 50*a* by detecting whether or not the two electrodes 58 are in conduction by the conduction detector circuit 59.

Moreover, in the embodiment, the arrangement is such that the detection of landing of the liquid droplet is carried out by detecting the deformation of the vibration plate 30 which is the liquid droplet landing body, by the piezoelectric element 31, and upon inclining the edge 33 of the vibration plate 30 in the transporting direction, the entire area of the landing surface 30*a* of the vibration plate 30 is let to be the detection area on which the landing is detected by the piezoelectric element 31. Supposedly, when the area of the vibration plate 30 on which the liquid droplets are landed is extended even on an outer side of the area on which the landing is detected by the piezoelectric element 31, the vibration plate 30 is deformed by landing of liquid droplets on such non-detection area on the outer side, and has a negative effect on the detection of landing on a detection area on an inner side thereof. Accordingly, it is preferable to let the entire area of the landing surface 30*a* of the vibration plate 30 to be a detection area for which the detection is to be carried out by the landing detection mechanism (piezoelectric element).

However, as in the modified embodiments from the seventh modified embodiment to the tenth modified embodiment, in a case of detecting directly the ink landed on the landing surface 50*a* of the liquid droplet landing body 50 by the optical sensor 53 (the light emitting element 51 and the light receiving element 52), the electric-potential detector circuit 56 which detects the change in the electric potential of the electrode 54 on the landing surface 50*a*, or the conduction detector circuit 59 which detects the conduction between the two electrodes 58, it is possible to make an arrangement such that, a detection area on which the landing is detected by a sensor or a detector such as the optical sensor 53, the electric-potential detector circuit 56, and the conduction detector circuit 59 is provided on a part of the landing surface 50*a* instead of letting the entire area of the landing surface 50*a* to be the detection area, and even when there is another area (area on which the landing is not detected) on which the liquid droplets can land, around the detection area provided, there is no effect in particular on the detection of landing on the detection area.

An example of the abovementioned structure (eleventh modified embodiment) is cited below.

Eleventh Modified Embodiment

Figure 15:
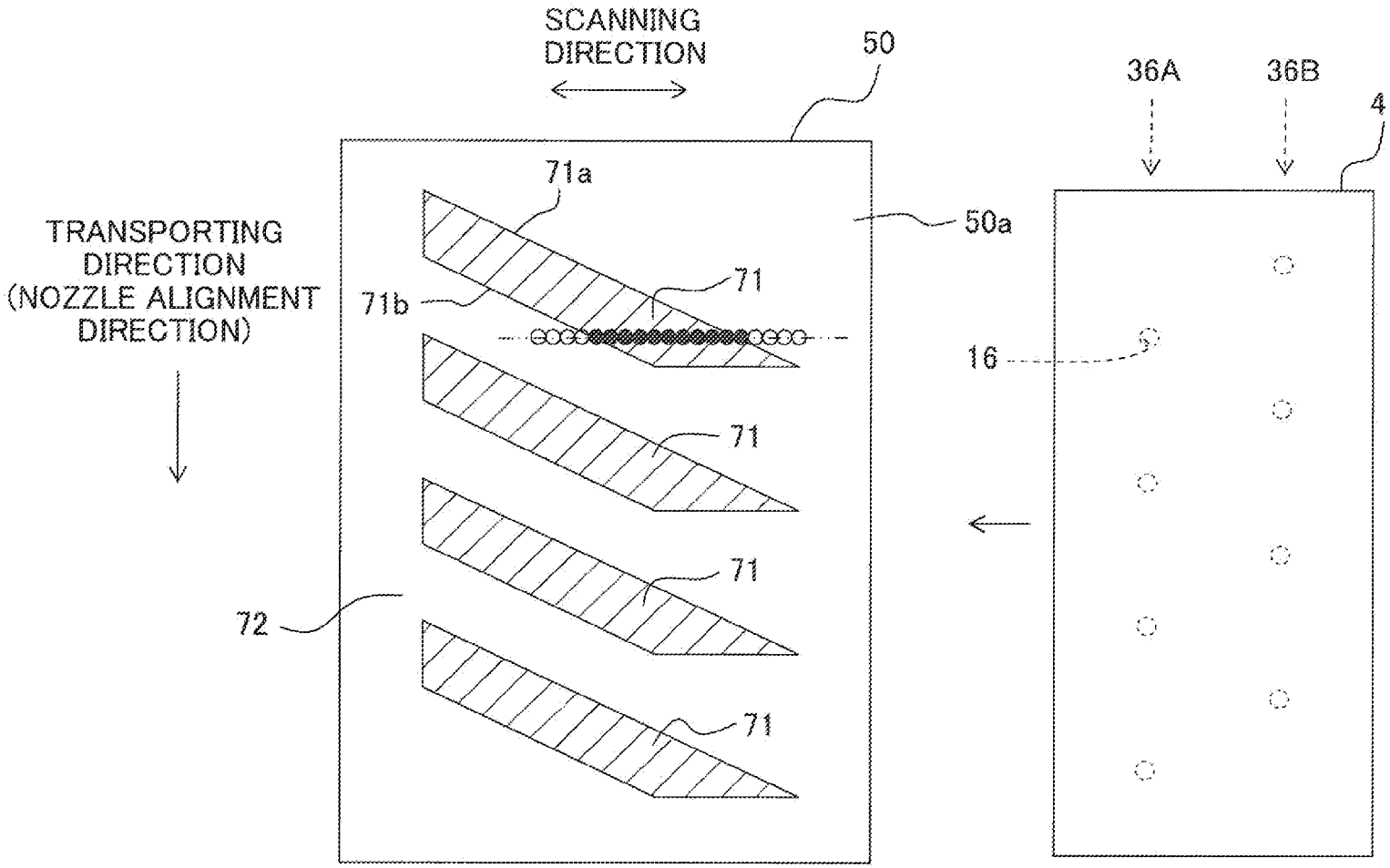
FIG. 15 is a plan view showing an example of a jetting state inspection unit according to an eleventh modified embodiment of the present teaching.

As shown in FIG. 15, a plurality of detection areas 71 on which, landing of liquid droplets is detected by a sensor or a detector such as the optical sensor 53, the electric-potential detector circuit 56, and the conduction detector circuit 59, is provided on the landing surface 50*a* of the liquid droplet landing body 50, corresponding to the plurality of nozzles 16 respectively belonging to one nozzle row 36. Moreover, the plurality of detection areas 71 is surrounded by non-detection area 72 on which liquid droplets land but no detection of landing of liquid droplets by a sensor such as the optical sensor 53 is carried out. Moreover, one edge 71*a* (boundary with the no-detection area 72) of each detection area 71 is extended in a direction which is inclined toward the scanning direction with respect to the transporting direction.

A supplementary description of a concrete structure of the detection area 71 will be made below. As shown in FIG. 11 (seventh modified embodiment), in a case of carrying out detection of landing from the change in the amount of light reflected, it is advisable to carry out surface treatment on the landing surface 50*a* such that the reflectivity of light at the detection area 71 is significantly higher as compared to the reflectivity of light on the no-detection area 72. For instance, for increasing absorptance (lowering the reflectivity) of light of the no-detection area 72, it is possible to adapt an arrangement in which the no-detection area 72 is daubed black. Moreover, as shown in FIG. 12 (eighth modified embodiment), it is possible to adapt an arrangement in which, a light shielding film which shields light of the light emitting element 51 is provided on the no-detection area 72 upon the liquid droplet landing body 50 being formed of a transparent material such that the transmittance of light at the detection area 71 becomes substantially higher than the transmittance of light at the no-detection area 72 in a case of carrying out the detection of landing from the change in the amount of light transmitted.

Moreover, as shown in FIG. 13 (ninth modified embodiment), in a case of carrying of the detection of landing from the change in the electric potential of the electrode 54 provided to the landing surface 50*a*, it is advisable that the electrode is arranged in the detection area 71. Furthermore, as shown in FIG. 14 (tenth modified embodiment), in a case of carrying out the detection of landing from the conductivity between the two electrodes 58, it is advisable that the two electrodes 58 are arranged at positions sandwiching the no-detection area 72 and the detection area 71. It is preferable that wettability of the detection area 71 is higher than the wettability of the surrounding no-detection area 72 so that the liquid droplets landed on the detection area 71 are spread rapidly and come in contact with each of the two electrodes 58.

As shown in diagrams from FIG. 11 to FIG. 14, in a case of carrying out the detection of landing of liquid droplets by detecting directly the ink on the detection area 71, when the liquid droplets which are jetted continuously from the nozzle 16 have started to land on the detection area 71, as a state of the detection area 71 changes from a state without the ink existing on the detection area 71 to a state with the ink existing on the detection area 71, it is possible to detect the timing of landing on the edge 71*a* at an upstream side of a direction of movement (right side in FIG. 15) of the ink-jet head 4. However, even when the landing of the liquid droplets on the detection area 71 is over, since the ink does not cease to exist immediately from the detection area 71, it is difficult to detect the timing of landing on the edge 71*a* at a downstream side of the direction of movement (left side in FIG. 15) of the ink-jet head 4. Therefore, it is preferable to judge the inclining of jetting from the mismatching of (difference in) timing of landing on the edge 71*a* on the right side.

Figure 16:
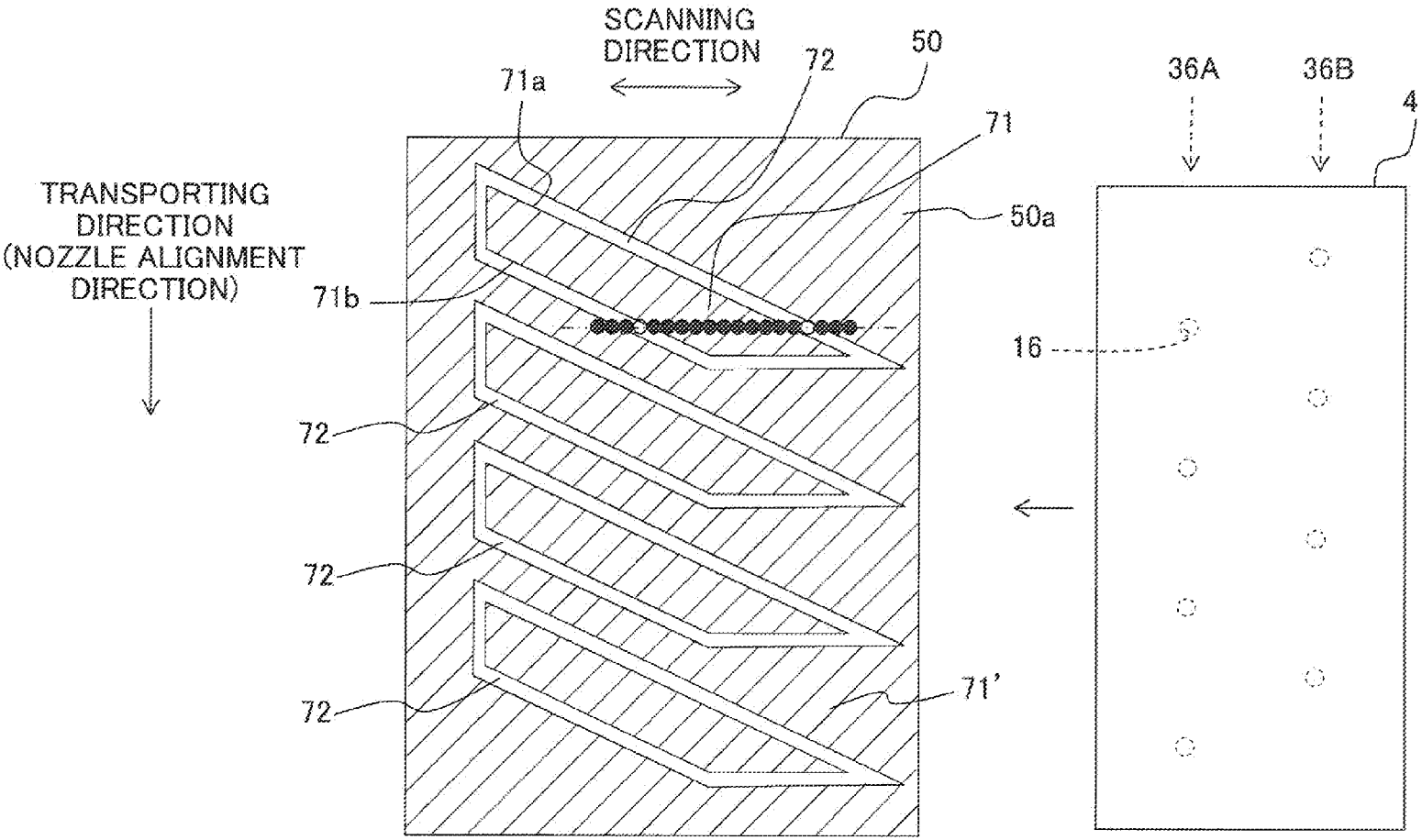
FIG. 16 is a plan view showing another example of the jetting state inspection unit according to the eleventh modified embodiment.

In the example in FIG. 15, each detection area 71 has been surrounded by the no-detection area 72 on which there is no detection of landing of liquid droplets. However, as shown in FIG. 16, the no-detection area 72 surrounding each detection area 71 may by surrounded by a detectable area 71' on which it is possible to carry out detection of landing of liquid droplets. It is advisable that the detectable area 71', similarly as the detection area 71, is arranged such that it is possible to detect directly the ink which has landed on the detectable area 71', by a sensor or a detector such as the optical sensor 53 (the light emitting element 51 and the light receiving element 52), the electric-potential detector circuit 56 which detects the electric potential of the electrode 54 on the landing surface 50*a*, or the conduction detector circuit 59 which detects the conduction between the two electrodes 58. According to such arrangement, since (the surrounding of) each detection area 71 is surrounded by the no-detection area 72, it is possible to make a judgment of inclined jetting by detecting the timing of landing on the edge 71*a* on the upstream side of the direction of movement (right side in FIG. 16) of the ink jet head 4 similarly as the example in FIG. 14. Furthermore, since the detectable area 71' is provided at the upstream side (right side in FIG. 6) and the downstream side (left side in FIG. 16) of the direction of movement of the ink-jet head 4, corresponding to the detection area 71 and the no-detection area 72, it is possible to detect landing of ink even on the detectable area 71'. Therefore, it is possible to make a judgment of whether or not the ink has been jetted continuously from the ink jet head 4 moving in the scanning direction.

Figure 17:
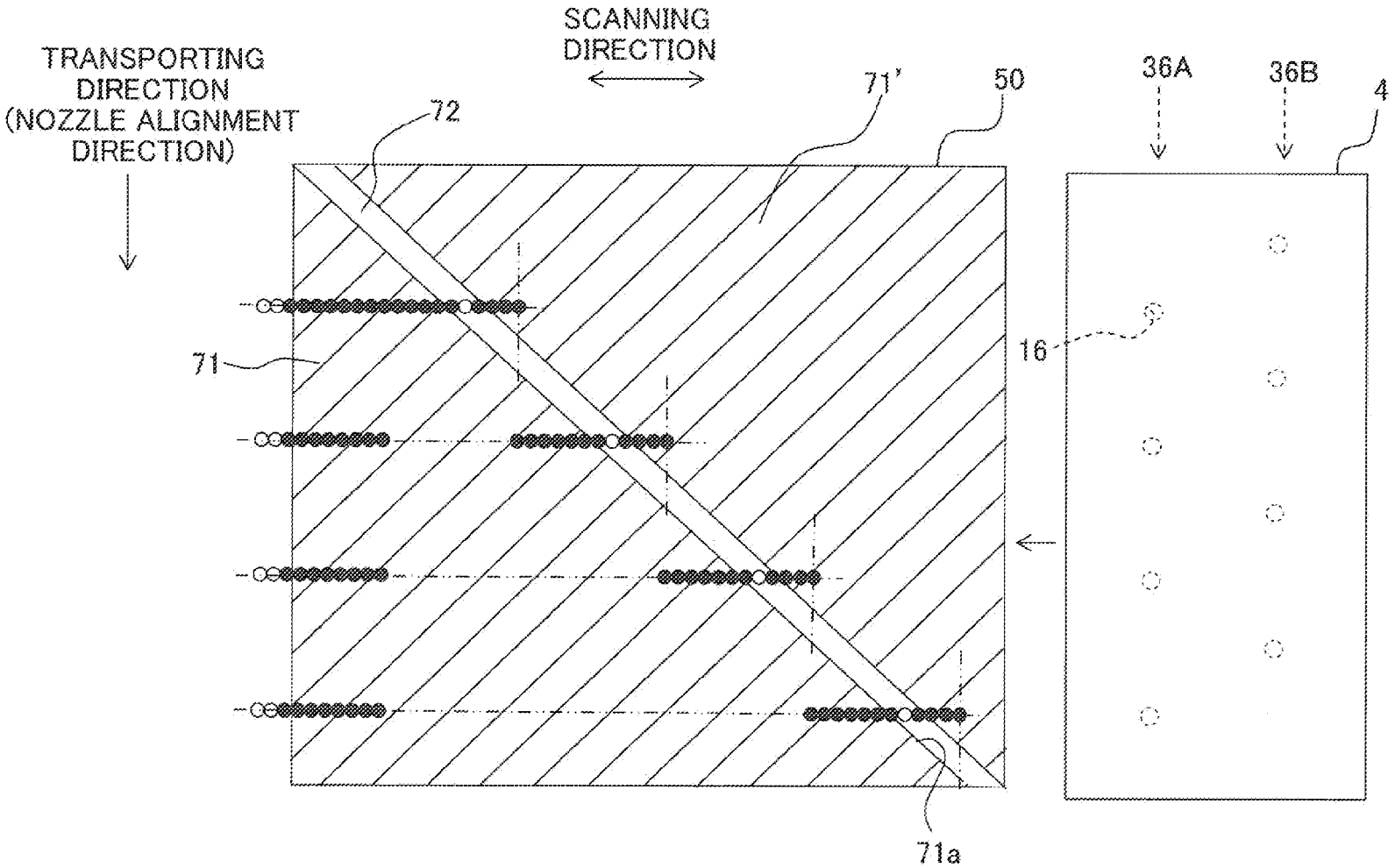
FIG. 17 is a plan view showing still another example of the jetting state inspection unit according to the eleventh modified embodiment.

Moreover in the examples in FIG. 15 and FIG. 16, the plurality of detection areas 71 has been provided corresponding to the plurality of nozzles 16 respectively, belonging to one nozzle row 36. However, only one detection area 71 may be provided corresponding to the plurality of nozzles belonging to one nozzle row. For instance, as shown in FIG. 17, the landing surface 50*a* of the rectangular-shaped liquid droplet landing body 50 may be provided with the detectable area 71' at the upstream side (upper-right side in FIG. 17) and the detection area 71 at the downstream side (lower-left side in FIG. 17) of the direction of movement of the ink-jet head 4, sandwiching the no-detection area 72 provided on one diagonal. Even in this case, similarly as the example in FIG. 16, it is advisable that the detectable area 71' is formed such that it is possible to detect directly the ink which has landed on the detectable area 71', by a sensor or a detector such as the optical sensor 53 (the light emitting element 51 and the light receiving element 52), the electric-potential detector circuit 56 which detects the electric potential of the electrode 54 on the landing surface 50*a*, or the conduction detector circuit 59 which detects the conduction between the two electrodes 58. Even with such arrangement, it is possible to make a judgment of inclined jetting by detecting the timing of landing on the edge 71*a* which is a boundary of the detection area 71 and the no-detection area 72. Furthermore, since the detectable area 71' is provided at the upstream side (upper-right side in FIG. 17) of the direction of movement of the ink-jet head 4 with respect to the detection area 71 and the no-detection area 72, it is possible to detect landing of ink even on the detectable area 71'. Therefore, it is possible to make a judgment of whether or not the ink has been jetted continuously from the ink-jet head 4 moving in the scanning direction.

Twelfth Modified Embodiment

Figure 18:
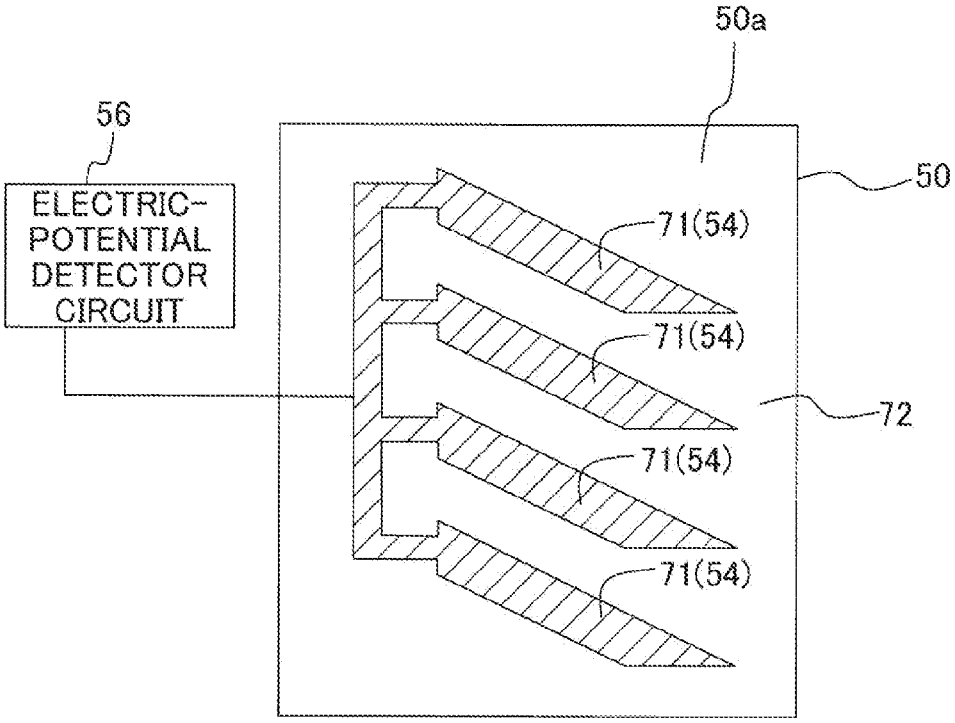
FIG. 18 is a plan view of a jetting state inspection unit according to a twelfth modified embodiment of the present teaching.

As shown in FIG. 13, in a case of detecting landing of liquid droplets by the change in the electric potential of the electrode 54 on the landing surface 50*a*, electrodes 54 of the plurality of detection areas 71 may be brought into mutual conduction as shown in FIG. 18. In this case, it is not possible to carry out detection of jetting of the nozzles 16 for the plurality of detection areas 71, but providing the electric-potential detector circuit 56 only at one location for the plurality of detection areas 71 serves the purpose, and the structure of the jetting detection unit 6 becomes simple.

4] In the embodiment, an example in which, suction purge and flushing are carried out selectively as two types of recovery operations for recovering the jetting performance of the nozzle 16 has been cited. However, the recovery operation is not restricted to suction purge and flushing (thirteenth modified embodiment). For instance, in a case in which, it is possible to make the ink discharge force of the suction purge differ by changing the suction force of the suction pump 23, it is possible to carry out selectively suction purge of two types with different ink discharge force based on the judgment result of the jetting state judgement section 67. Or, instead of the suction purge in which the ink is sucked by applying a negative pressure from the nozzle 16 side, it is also possible to adapt a so-called pressurized purge in which, the ink is discharged forcibly from the nozzle by pressurizing the ink by a pump from an ink channel on the upstream side of the nozzle 16.

5] When the liquid droplets are still adhered to the landing surface of the liquid droplet landing body after the detection is carried out by the jetting detection unit 6, as there is a possibility of a misdetection when the subsequent detection has been carried out, it is preferable that an arrangement is made such that the liquid droplets adhered to the landing surface are removed. An example of an arrangement for such removal of liquid droplets is cited below.

Fourteenth Modified Embodiment

Figure 19:
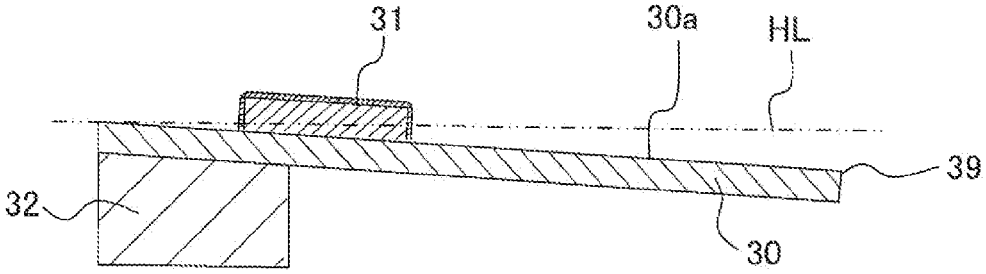
FIG. 19 is a cross-sectional view showing an example of a jetting state inspection unit according to a fourteenth modified embodiment of the present teaching.
Figure 20:
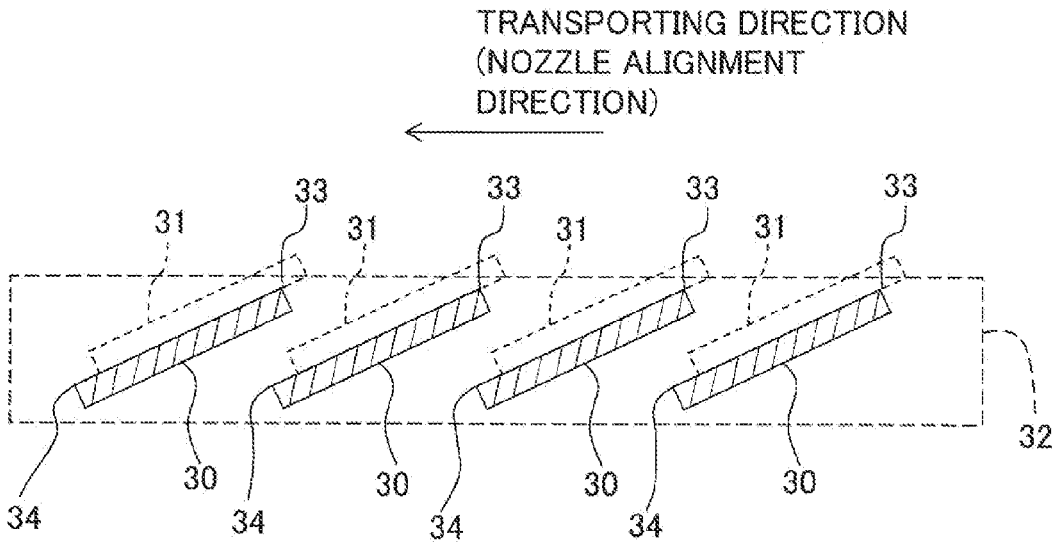
FIG. 20 is a cross-sectional view showing another example of the jetting state inspection unit according to the fourteenth modified embodiment.

As in the embodiment, in a case in which, the landing surface 30*a* of the liquid droplet landing body (vibration plate 30) is facing the liquid droplet jetting surface 4*a* of the ink-jet head 4 in the vertical direction, an arrangement in which the landing surface 30*a* is inclined with respect to a horizontal surface HL as shown in FIG. 19 may be adapted. Concretely, the landing surface 30*a* of the liquid droplet landing body may be inclined such that a distance from the horizontal surface HL increases toward the front-end edge 39. Or, as shown in FIG. 20, the landing surface 30*a* of the liquid droplet landing body may be inclined such that the edge 34 at the downstream side of the transporting direction becomes lower than the edge 33 at the upstream side of the transporting direction. In the abovementioned arrangements, since the liquid droplets which have landed on the detection area of the landing surface 30*a* run down due to gravitational force, the liquid droplets hardly remain on the detection area.

Fifteenth Modified Embodiment

Figure 21:
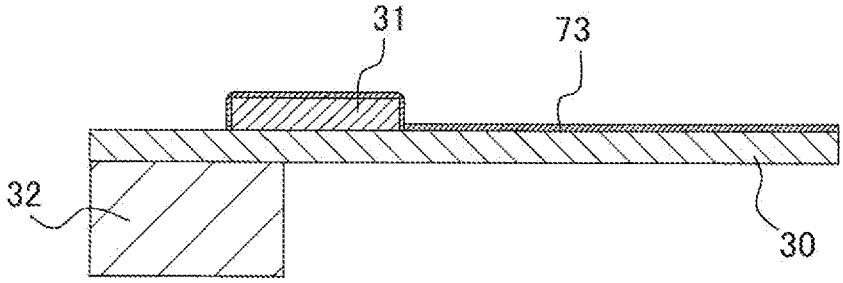
FIG. 21 is a cross-sectional view showing a jetting state inspection unit according to a fifteenth modified embodiment of the present teaching.

As shown in FIG. 21, the landing surface 30*a* of the liquid droplet landing body (vibration plate 30 in the diagram) may be covered by a liquid repellent film 73 (such as a fluororesin film) having a liquid repellent property superior to a liquid repellent property of the landing surface 30*a*. As shown in FIG. 15 described above, in the case in which, the detection area 71 is provided not on the entire area of the landing surface of the liquid droplet landing body but only on a part thereof, the entire area of the landing surface is not required to be covered by the liquid repellent film 73, and at least the detection area 71 is to be covered by the liquid repellent film 73. In a structure in FIG. 21, since the liquid droplets which have landed on the landing surface 30*a* (detection area) are repelled by the liquid repellent film 73 to an outside, the liquid droplets hardly remain on the landing surface 30*a*.

Sixteenth Modified Embodiment

Figure 22:
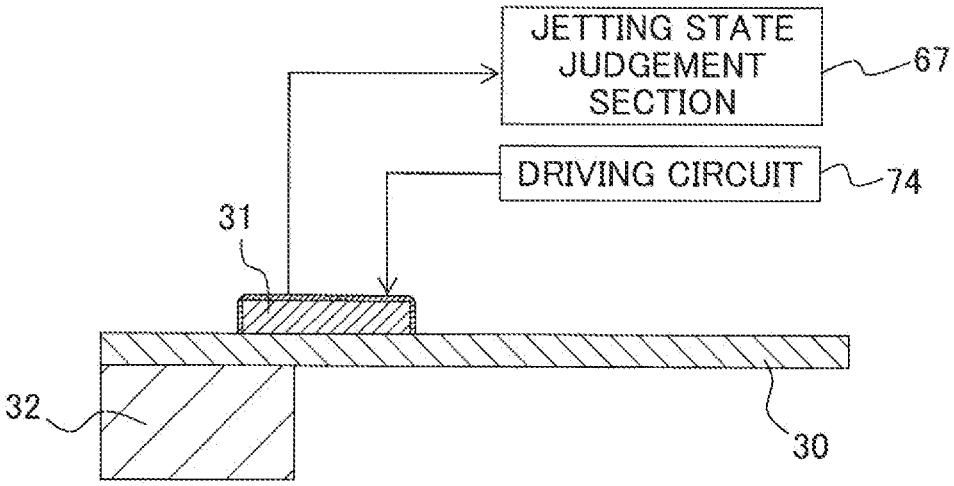
FIG. 22 is a cross-sectional view showing a jetting state inspection unit according to a sixteenth modified embodiment of the present teaching.

As in the embodiment, in the arrangement in which, the deformation of the vibration plate 30 when the liquid droplets have landed is detected by the piezoelectric element 31 (made to function as a piezoelectric sensor), a driving circuit 74 (drive unit) which drives the piezoelectric element 31 as a piezoelectric actuator contrariwise as shown in FIG. 22. In other words, while the piezoelectric element 31 outputs a voltage-change when the vibration plate 30 has deformed due to landing of liquid droplets, to the jetting state judgement section 67 in the control unit 8, it vibrates when a voltage is applied by the driving circuit 74 after the liquid droplets have landed on the landing surface 30*a* (after the end of detection). At this time, as the vibration plate 30 also vibrates, it is possible to drop down the liquid droplets landed on the landing surface 30*a* of the vibration plate 30.

Seventeenth Modified Embodiment

Figure 23:
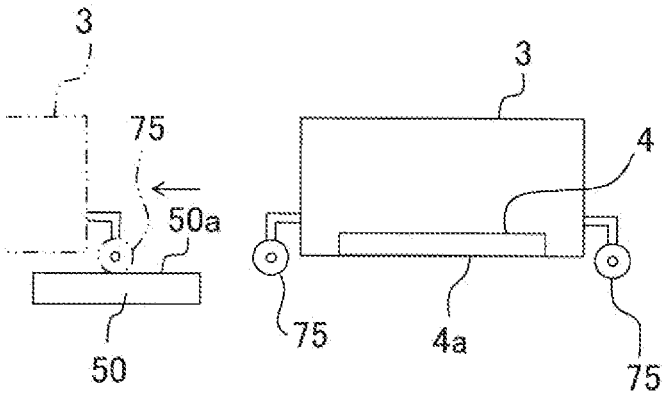
FIG. 23 is a diagram showing cleaning of a liquid droplet landing body according to a seventeenth modified embodiment of the present teaching.

The jetting detection unit 6 may include a cleaning means which removes the ink adhered to the landing surface of the liquid droplet landing body. For instance, as shown in FIG. 23, an arrangement may be such that, a cleaning member 75 such as a roller or a foam is provided to two-end portions (may be only to one-end portion) in the scanning direction of the carriage 3, and when the carriage 3 moves with respect to the liquid droplet landing body 50 for detecting jetting of the nozzle 16, the cleaning member 75 also moves in the scanning direction together with the carriage 3, and wipes the ink adhered to the landing surface 50*a* of the liquid droplet landing body 50.

Or, an arrangement may be such that the cleaning member is arranged to be movable in the scanning direction near the liquid droplet landing body, and with an engaging portion which is engaged with the cleaning member of the carriage 3 provided, follows the movement in the scanning direction of the carriage 3, and the cleaning member which is engaged with the engaging portion moves in the scanning direction and wipes the landing surface 50*a* of the liquid droplet landing body 50. Furthermore, the cleaning member may be a member which moves with respect to the landing surface of the liquid droplet landing body independently irrespective of the scanning of the carriage 3.

6] The liquid droplet landing body may be a body which moves in the scanning direction (direction orthogonal to the transporting direction) with respect to the ink-jet head 4 (eighteenth modified embodiment). However, in a so-called serial printer as in the embodiment, in which, the ink-jet head 4 reciprocates in the scanning direction at the time of recording, as the ink jet head 4 is to be moved even at the time of inspecting jetting, primarily, there is no need to move the liquid droplet landing body, and it is not necessary to structure the liquid droplet landing body presumably to be movable in the scanning direction.

Figure 24:
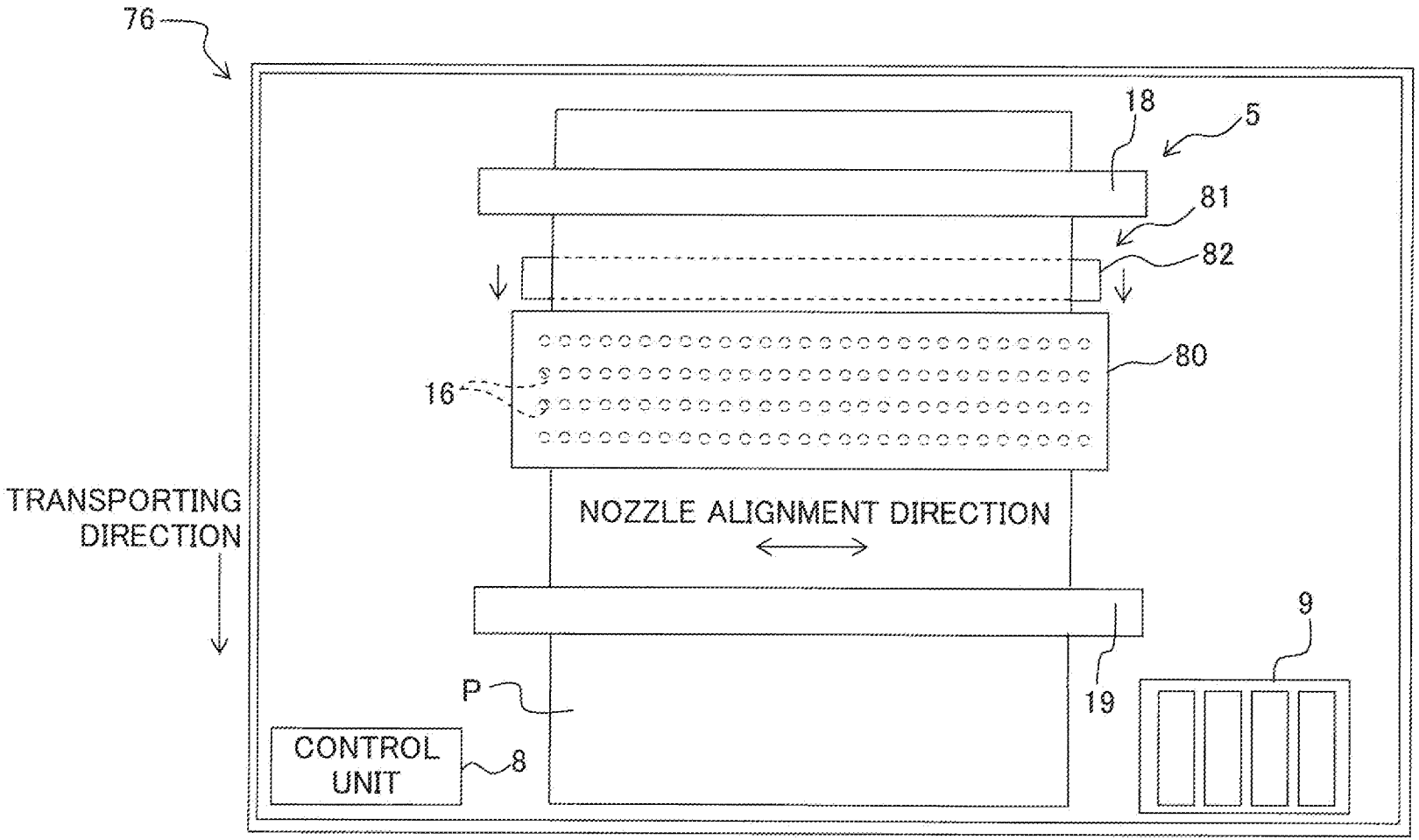
FIG. 24 is a schematic structural view of a line printer according to an eighteenth modified embodiment of the present teaching.

However, the present teaching is not restricted to the serial printer, and is also applicable to an ink-jet printer 76 (a so-called line printer) which includes an ink-jet head 80 having a plurality of nozzles 86 arranged in rows in a direction of width of the recording paper P as shown in FIG. 24. In the line printer 76, a position of the ink-jet head 80 at the time of recording is fixed, and an image etc. is recorded on the recording paper P by the paper P being transported in a transporting direction which is orthogonal to the direction in which the nozzles are arranged in row.

Even in such line printer, when the jetting is inclined in the direction in which the nozzles are arranged in row (direction of width of the recording paper P: third direction), as white stripes in a vertical direction (transporting direction) appear on the recording paper, it is highly significant to apply the present teaching which enables to detect the jetting inclined in the direction in which the nozzles are arranged in row.

In that case, as the ink-jet head 80 does not move, a liquid droplet landing body 82 of a jetting detection unit 81 is structured to be movable in the transporting direction (second direction: secondary scanning direction) which is orthogonal to the direction in which the nozzles are arranged in row (first direction: main scanning direction). Moreover, a position of the liquid droplet landing body 82 in the transporting direction with respect to the ink-jet head 80 is detected by a position detection mechanism (not shown in the diagram) such as a linear encoder. Furthermore, it is possible to detect inclined jetting from a timing of landing on an edge (not shown in the diagram) of the liquid droplet landing body 82, which is inclined with respect to the direction in which the nozzles are arranged in row by moving the liquid droplet landing body 82 in the transporting direction with respect to the ink-jet head 80 while jetting liquid droplets from the nozzle 86 of the ink-jet head 80. Even in the line printer 76, the direction in which the nozzles are arranged in row (first direction) of the ink-jet head 80 may be inclined with respect to the direction of width of the recording paper P (third direction).

The embodiment and the modified embodiments thereof which have been described above, are examples in which the present teaching is applied to an ink-jet printer. However, since detecting the inclined jetting of a nozzle is considered to be important even in a liquid droplet jetting apparatus which is to be used for an application other than image recording, the present teaching is applicable irrespective of the application of the liquid droplet jetting apparatus.

What is claimed is:

1. A liquid droplet jetting apparatus which jets liquid droplets, comprising:

a liquid droplet jetting head which has a liquid droplet jetting surface on which a plurality of nozzles are open and aligned in a row in a first direction; and a liquid droplet jetting state inspection unit which inspects liquid droplet jetting state of each of the nozzles, including:

a liquid droplet landing body which has a landing surface facing the liquid droplet jetting surface and on which the liquid droplets jetted from each of the nozzles land, and which is configured to be movable, with respect to the liquid droplet jetting head, in a second direction which is parallel to the liquid droplet jetting surface and intersects the first direction; and a landing detection mechanism which detects whether or not the liquid droplets have landed on a predetermined detection area provided on the landing surface of the liquid droplet landing body;

wherein the detection area of the landing surface has a first edge which extends in a direction inclined toward the second direction with respect to a third direction which is orthogonal to the second direction.

2. The liquid droplet jetting apparatus according to claim 1, further comprising:

a position detection mechanism which detects a position of the liquid droplet jetting head in the second direction with respect to the liquid droplet landing body; and a judging section which judges the liquid droplet jetting state of each of the nozzles, based on a detection result of the landing detection mechanism;

wherein the judging section judges whether or not a liquid droplet jetting direction of each of the nozzles is inclined with respect to a predetermined direction, based on a position of the liquid droplet jetting head in the second direction with respect to the liquid droplet landing body at the time when one of the liquid droplets has been detected to have landed on the first edge by the landing detection mechanism.

3. The liquid droplet jetting apparatus according to claim 2;

wherein, in a state that the liquid droplet jetting head and the liquid droplet landing body have been moved relatively in the second direction while jetting the liquid droplets continuously from one of the nozzles, the landing detection mechanism detects that one of the liquid droplets has landed on the first edge by detecting a timing at which the liquid droplets start to land on the detection area or a timing at which the liquid droplets start to land on outside the detection area.

4. The liquid droplet jetting apparatus according to claim 1;

wherein the detection area is provided as a plurality of detection areas, on the landing surface of the liquid droplet landing body, aligned in the third direction leaving spaces therebetween; and wherein the landing detection mechanism detects landings of the liquid droplets on the detection areas separately.

5. The liquid droplet jetting apparatus according to claim 4;

wherein the plurality of detection areas correspond to the plurality of nozzles respectively.

6. The liquid droplet jetting apparatus according to claim 1;

wherein the detection area of the landing surface has a second edge extending in a direction which intersects with the second direction and which is different from the direction in which the first edge extends.

7. The liquid droplet jetting apparatus according to claim 6;

wherein the second edge extends in the third direction.

8. The liquid droplet jetting apparatus according to claim 2;

wherein the liquid droplet jetting head is configured to be movable in the second direction and the position detection mechanism detects the position of the liquid droplet jetting head in the second direction.

9. The liquid droplet jetting apparatus according to claim 1;

wherein an angle made by the first edge with respect to the third direction is 45° or more, but less than 90°.

10. The liquid droplet jetting apparatus according to claim 1;

wherein the liquid droplet jetting surface of the liquid droplet jetting head faces the landing surface of the liquid droplet landing body in a vertical direction; and wherein the landing surface is inclined with respect to a horizontal surface.

11. The liquid droplet jetting apparatus according to claim 1;

wherein at least the detection area of the landing surface is covered by a liquid repellent film.

12. The liquid droplet jetting apparatus according to claim 1;

wherein the liquid droplet landing body has a vibration plate, one surface of which is the landing surface facing the liquid droplet jetting surface;

wherein the landing detection mechanism detects deformation of the vibration plate under a condition that the liquid droplets have landed on the landing surface; and wherein one edge of the vibration plate extends, in the direction inclined toward the second direction with respect to the third direction, to form the first edge of the detection area.

13. The liquid droplet jetting apparatus according to claim 12;

wherein the liquid droplet jetting state inspection unit has a supporting member which extends in the third direction; and wherein the vibration plate is cantilever-supported at one-end portion thereof by the supporting member.

14. The liquid droplet jetting apparatus according to claim 12;

wherein the landing detection mechanism has a piezoelectric element provided to the vibration plate.

15. The liquid droplet jetting apparatus according to claim 14, further comprising:

a drive unit which drives the piezoelectric element;

wherein, after the liquid droplets jetted from each of the nozzles have landed on the landing surface of the vibration plate, the drive unit drives the piezoelectric element to vibrate the vibration plate.

16. The liquid droplet jetting apparatus according to claim 1;

wherein the landing detection mechanism has:

a light emitting element which irradiates light toward the liquid droplet landing body; and a light receiving element which receives light irradiated from the light emitting element; and wherein the landing detection mechanism detects a change in an amount of light received by the light receiving element under a condition that the liquid droplets have landed on the detection area.

17. The liquid droplet jetting apparatus according to claim 16;

wherein the liquid droplet landing body, at least in the detection area, is made of a material which allows light to pass through in a thickness direction thereof;

wherein the liquid droplets jetted from the nozzles have a light shielding property; and wherein the light emitting element and the light receiving element are arranged to sandwich a portion, of the liquid droplet landing body, in which the detection area is provided, in a direction orthogonal to the landing surface.

18. The liquid droplet jetting apparatus according to claim 2, further comprising:

a recovery mechanism which recovers jetting performance of the nozzles by discharging liquid from the nozzles;

wherein, under a condition that the judging section judges that a liquid droplet jetting direction of a certain nozzle is inclined, the recovery mechanism performs a recovery operation for the certain nozzle.

19. The liquid droplet jetting apparatus according to claim 18;

wherein the recovery mechanism is configured to be performable two types of recovery operations with different liquid discharge performance; and wherein the recovery mechanism performs selectively one of the two types of recovery operations based on a judgment result of the judging section.

20. The liquid droplet jetting apparatus according to claim 19;

wherein the recovery mechanism firstly performs a first recovery operation for the certain nozzle with a first liquid discharge performance; and wherein, under a condition that the judging section judges that the liquid droplet jetting direction of the certain nozzle is inclined after the first recovery operation has been performed, the recovery mechanism performs a second recovery operation for the certain nozzle with a second liquid discharge performance higher than the first liquid discharge performance.

21. The liquid droplet jetting apparatus according to claim 19;

wherein the detection area of the landing surface has a second edge extending in the third direction;

wherein the judging section judges whether the liquid droplet jetting direction of the certain nozzle is inclined at least in the third direction with respect to the predetermined direction or only in the second direction, based on positions of the liquid droplet jetting head in the second direction under a condition that one of the liquid droplets lands on the first edge and under a condition that another of the liquid droplets lands on the second edge;

wherein the recovery mechanism performs the first recovery operation with a first liquid discharge performance, under a condition that the judging section judges that the liquid droplet jetting direction of the certain nozzle is inclined only in the second direction; and wherein the recovery mechanism performs the second recovery operation with a second liquid discharge performance which is higher than the first liquid discharge performance, under a condition that the judging section judges that the liquid droplet jetting direction of the certain nozzle is inclined at least in the third direction.

22. The liquid droplet jetting apparatus according to claim 20;

wherein the first recovery operation is a flushing operation for the nozzles; and wherein the second recovery operation is a purge operation in which the liquid is discharged forcibly from the nozzles by applying a pressure to the liquid in the nozzles from outside of the liquid droplet jetting head.

23. A liquid droplet jetting state inspection unit which inspects liquid droplet jetting state of each of a plurality of nozzles of a liquid droplet jetting head having a liquid droplet jetting surface on which the nozzles are open and aligned in a row in a first direction, the unit comprising:

a liquid droplet landing body which has a landing surface facing the liquid droplet jetting surface and on which liquid droplets jetted from each of the nozzles land, and which is configured to be movable, with respect to the liquid droplet jetting head, in a second direction which is parallel to the liquid droplet jetting surface and intersects the first direction; and a landing detection mechanism which detects whether or not the liquid droplets have landed on a predetermined detection area provided on the landing surface of the liquid droplet landing body;

wherein the detection area of the landing surface has a first edge which extends in a direction inclined toward the second direction with respect to a third direction which is orthogonal to the second direction.

* * * * *